US010918127B2

(12) United States Patent
Fuisz et al.

(10) Patent No.: US 10,918,127 B2
(45) Date of Patent: Feb. 16, 2021

(54) VAPORIZABLE TOBACCO WAX COMPOSITIONS AND CONTAINER THEREOF

(71) Applicant: Bond Street Manufacturing LLC, Surfside, FL (US)

(72) Inventors: Joseph M. Fuisz, Surfside, FL (US); Seamus Henry, Fort Lauderdale, FL (US)

(73) Assignee: BOND STREET MANUFACTURING LLC, Nashville, TN (US)

( * ) Notice: Subject to any disclaimer, the term of this patent is extended or adjusted under 35 U.S.C. 154(b) by 0 days.

(21) Appl. No.: 16/159,015

(22) Filed: Oct. 12, 2018

(65) Prior Publication Data

US 2019/0045834 A1 Feb. 14, 2019

Related U.S. Application Data

(63) Continuation-in-part of application No. 15/923,587, filed on Mar. 16, 2018, which is a (Continued)

(51) Int. Cl.
*A24B 15/167* (2020.01)
*A24B 15/24* (2006.01)
(Continued)

(52) U.S. Cl.
CPC ..... *A24B 15/167* (2016.11); *A24B 15/24* (2013.01); *A24B 15/241* (2013.01);
(Continued)

(58) Field of Classification Search
CPC ..... A24B 15/167; A24F 47/008
(Continued)

(56) References Cited

U.S. PATENT DOCUMENTS 1,624,155 A 4/1927 Amster et al.
2,128,043 A 8/1938 Garner
(Continued)

FOREIGN PATENT DOCUMENTS

WO 2016050472 A1 4/2016
WO WO-2016178098 A2 * 11/2016 ..... A24F 47/008

OTHER PUBLICATIONS

Solid Surface Energy Data, Surface-Tension, http://www.surface-tension.de/solid-surface-energy.htm (Year: 2018).*
(Continued)

*Primary Examiner* — Eric Yaary
*Assistant Examiner* — Russell E Sparks
(74) *Attorney, Agent, or Firm* — Fitch, Even, Tabin & Flannery, LLP

(57) ABSTRACT

The invention relates to tobacco wax compositions suitable for use in a vaporizer. The tobacco wax may comprise additional excipients including vapor agents, penetration agents, buffer agents, and rheological agents. The composition contains nicotine. The tobacco wax composition leaves a minimum of residue in the vaporizer when used. In another aspect, the invention relates to a portion-sized container ("pod") of a tobacco wax composition for administration to a mammal or person. The pod is intended for use in a personal (or other) vaporizer.

14 Claims, 9 Drawing Sheets

Related U.S. Application Data continuation-in-part of application No. 15/638,609, filed on Jun. 30, 2017, which is a continuation-in-part of application No. 15/403,472, filed on Jan. 11, 2017, which is a continuation-in-part of application No. 15/276,902, filed on Sep. 27, 2016, said application No. 15/923,587 is a continuation-in-part of application No. PCT/US2017/053416, filed on Sep. 26, 2017, which is a continuation-in-part of application No. 15/638,609, filed on Jun. 30, 2017.

(51) Int. Cl.

| | |
|---|---|
| ***A24F 47/00*** | (2020.01) |
| ***A24F 40/42*** | (2020.01) |
| ***A24F 40/20*** | (2020.01) |
| ***A24B 15/28*** | (2006.01) |
| ***A24B 15/32*** | (2006.01) |

(52) U.S. Cl.
CPC ..... *A24B 15/287* (2013.01); *A24B 15/32* (2013.01); *A24F 40/20* (2020.01); *A24F 40/42* (2020.01); *A24F 47/008* (2013.01)

(58) Field of Classification Search
USPC ..... 131/352
See application file for complete search history.

(56) References Cited

U.S. PATENT DOCUMENTS

| | | | | |
|---|---|---|---|---|
| 4,000,327 | A * | 12/1976 | Tseng | C07C 17/16 426/534 |
| 4,936,920 | A | 6/1990 | Keritsis et al. | |
| 6,907,887 | B2 * | 6/2005 | Conkling | A24B 15/10 131/270 |
| 8,613,285 | B2 * | 12/2013 | Fuisz | A24B 13/00 131/352 |
| 8,863,754 | B2 | 10/2014 | Renaud et al. | |
| 8,897,628 | B2 * | 11/2014 | Conley | A24F 47/008 392/386 |
| 9,038,644 | B2 | 5/2015 | Brown et al. | |
| 9,674,894 | B2 * | 6/2017 | Schneider | A24F 47/008 |
| 2005/0066986 | A1 * | 3/2005 | Nestor | A24D 1/00 131/364 |
| 2016/0157524 | A1 * | 6/2016 | Bowen | A24F 47/008 128/200.14 |
| 2016/0270447 | A1 * | 9/2016 | Borkovec | A24F 47/008 |
| 2016/0353799 | A1 * | 12/2016 | Otto | A24F 47/008 |
| 2017/0280776 | A1 * | 10/2017 | Manca | A24F 47/008 |
| 2018/0027883 | A1 * | 2/2018 | Zuber | A24F 47/008 |
| 2019/0274353 | A1 * | 9/2019 | Sur | A61M 11/042 |

OTHER PUBLICATIONS

Innovations in Bonding to Low Surface Energy Surfaces, Industrial Adhesives and Tapes Division, 3M, https://multimedia.3m.com/mws/media/755526O/innovations-in-bonding-to-low-surface-energy-white-paper.pdf (Year: 2015).*

Vape Pens & "High" Viscosity, Paulino, R., RheoSense, Inc., https://blog.rheosense.com/vape-pens-high-viscosity (Year: 2017).*

* cited by examiner

VAPORIZABLE TOBACCO WAX COMPOSITIONS AND CONTAINER THEREOF

CROSS-REFERENCE TO RELATED APPLICATIONS

This application is a continuation-in-part of application Ser. No. 15/923,587, filed Mar. 16, 2018, which is a continuation-in-part of application Ser. No. 15/638,609, filed Jun. 30, 2017, which is a continuation-in-part of application Ser. No. 15/403,472, filed Jan. 11, 2017, which is a continuation of application Ser. No. 15/276,902, filed Sep. 27, 2016; application Ser. No. 15/638,609 is also a continuation-in-part of application Ser. No. 15/276,902, filed Sep. 27, 2016. This application is also a continuation-in-part of PCT International Application No. PCT/US2017/053416, filed Sep. 26, 2017 and designating the US, which claims the benefit of the filing dates of application Ser. No. 15/638,609, fled Jun. 30, 2017, application Ser. No. 15/403,472, filed Jan. 11, 2017, and application Ser. No. 15/276,902, filed Sep. 27, 2016. The contents of all of the foregoing related applications are incorporated herein by reference in their entireties.

TECHNICAL FIELD

This invention is directed towards tobacco wax, including methods of manufacture, tobacco wax compositions, and the vaporization of tobacco wax for use in a vaporizer-inhalation device. The present invention also relates to a portion-sized container ("pod") of a tobacco wax composition for administration to a mammal or person. The pod is intended for use in a personal (or other) vaporizer.

BACKGROUND OF THE INVENTION

In 1926, Samual Amster of Richmond, Kentucky described the extraction of a "wax like substance" from tobacco using a hot water process and then subjecting the resulting liquor to an evaporative step. Despite this extraction, Amster teaches that the (extracted) tobacco "may still be employed for smoking and chewing tobacco." Amster teaches the use of the tobacco "wax like substance" in candles, shoe polishes and varnish (U.S. Pat. No. 1,624,155).

In 1936, James Gamer of Mount Lebanon, Pa., described a method to de-nicotinize tobacco, whereby ammonia treated tobacco is subjected to a butane-solvent based extraction method. When the butane is evaporated, "there is left a mass of nicotine and tobacco wax which together may amount to as much as 6-8% by weight of the tobacco used . . . . Tobacco wax or resin is dark brown in color, burns with the production of acrid fumes, and has a strong odor resembling that of an "old" pipe." The tobacco wax may be used as an insecticide or may be "returned to the residual tobacco leaves and also to untreated tobacco leaves to impart thereto desirable flavors." Like Amster, Gamer teaches that the extracted tobacco is still suitable use in smoking and other tobacco products (U.S. Pat. No. 2,128,043).

Despite this eighty year old work, Applicants are not aware that the teachings of Amster or Gamer have been used in commercial processes or products.

Entering the present era, Keritsis et al (U.S. Pat. No. 4,936,920) (1990) mentions tobacco wax in a list of saccharides and polysaccharides that may be used as a bonding agent when making manufactured tobacco (more typically referred to as reconstituted tobacco sheet).

Renaud et al., in U.S. Pat. No. 8,863,754 (2014) describe compositions for heat not burn applications The patent mentions tobacco wax in a reference to degradation products the presence of which evidences (unwanted) combustion: "Isoprene is a pyrolysis product of isoprenoid compounds present in tobacco, for example in certain tobacco waxes, and can be present in the aerosol only if the strands of homogenized tobacco material are heated to a temperature substantially higher than that required to generate an aerosol. Thus, isoprene yield can be taken as representative of the amount of homogenized tobacco material that is "over heated."" Nothing in the disclosure indicates that tobacco wax has been purposefully used in this composition or otherwise present than through the natural presence of wax in the tobacco used to manufacture the "homogenized tobacco material." Applicant understands the substrate described in this art to be a reconstituted tobacco sheet intended for use in heat not burn applications.

Brown et al. (U.S. Pat. No. 9,038,644) (2015) teaches tobacco wax for use as a phase transition material to impart reduced ignition propensity to a cigarette. The wax is applied to the cigarette paper using high precision wax jet printing.

Each of U.S. Pat. Nos. 1,624,155; 2,128,043; 4,936,920; 4,936,920; 8,863,754; and 9,038,644, is expressly incorporated herein together with all citations in these references.

The vaporization of nicotine containing liquids is well known and popular, including using devices such as electronic cigarettes and tank-style (and non tank) personal vaporizers. Typically such compositions include USP (99.9% pure) nicotine oil as an ingredient, though zero-liquids without any nicotine are also used.

Heat not burn tobacco systems are known in the tobacco industry. Heat not burn systems like PAX Labs, Inc.'s PAX® and PMI's IQOS® (as well as earlier versions of IQOS® sold as HEATBAR® and ACCORD®) heat tobacco compositions substantially without burning the tobacco, thereby aerosolizing volatile constituents of the tobacco composition. After use, the non-vaporized components of the tobacco composition remain minus those components what were successfully vaporized (or inadvertently burned).

In the case of both PAX® and IQOS® this residue is substantial and represents the substantial mass of the original tobacco composition.

Philip Morris International (PM) describes the rationale behind hear not burn systems thusly: "[t]he concept behind 'heat-not-burn' is that heating tobacco, rather than burning it, reduces or eliminates the formation of many of the compounds that are produced at the high temperatures associated with combustion. Research has demonstrated that most of the harmful and potentially harmful constituents (HPHCs) in cigarette smoke are formed by thermal breakdown of the tobacco when it is burned. Heat-not-burn therefore offers the possibility of significantly reducing both the number and the levels of HPHCs generated by tobacco products, whilst retaining an acceptable sensory experience for current adult smokers" (from pmiscience.com).

Now, some criticism has been leveled against heat not burn systems, which ostensibly is premised on the notion that tobacco and heat will always tend lead to toxicant formation. Stephen Stotesbury, head of scientific and regulatory affairs for imperial Tobacco has been quoted saying about Philip Morris International's IQOS [heat not burn] system: "There's a lot of black crud in the iQOS device after using it . . . . It smells like an ashtray." Perhaps not surprisingly, Imperial Tobacco has stated it will not develop a heat not burn product—presumably to rely solely on its electronic nicotine delivery systems.

PAX is a loose-leaf style vaporizer for use with "loose-leaf plant material" supplied by the user herself (paxvapor.com/support/pax-2-faq/#can-1-use-liquids-in-pax-2). An earlier heat not burn composition—Pax Labs, Inc.'s PLOOM® used a tobacco-humectant composition contained in NESCAFE® style pod—however this product has been discontinued.

PMI's IQOS® is a more sophisticated product wherein the user uses a manufacturer-supplied "cigarette" in the heating device. The cigarette itself is comprised of reconstituted tobacco sheet made with high amounts of humectant (glycerin) that, together with other volatiles, create a vapor like experience when used.

Applicants believe the composition of the reconstituted sheet used in IQOS® is akin to that described in WO2016050472A1. One of the present inventors has extensive experience working with film and sheet systems, principally for pharmaceutical applications and is a named inventor on Fuisz et al. U.S. Pat. Nos. 9,108,340; 8,906,277; 8,685,437; 8,663,687; 8,652,378; 8,617,589; 8,613,285; 8,603,514; 8,241,661; 8,017,150; 7,972,618; 7,897,080; 7,824,588; 7,666,337; and 7,425,292.

Heat not burn systems are associated with reduced HPHCs as stated by the PMIScience excerpt above. The toxicant profile of burning tobacco is well understood. Researchers have estimated that cigarette smoke contains 7,357 chemical compounds from many different classes (Warnatz, J, U Maas and R W Dibble. Combustion: physical and chemical fundamentals, modeling and simulation, experiments, pollutant formation. 2006). There is broad scientific agreement that several of the major classes of chemicals in the combustion emissions of burned tobacco are toxic and carcinogenic (Rodgman, A, and T A Perfetti. The chemical components of tobacco and tobacco smoke. 2013: CRC press).

BRIEF SUMMARY OF THE INVENTION

The present invention relates to a tobacco wax composition suitable for vaporization, comprising tobacco wax and at least one vapor agent.

The tobacco wax composition can have a nicotine content of greater than 2%.

The tobacco wax composition is preferably flowable.

The tobacco wax composition may further comprise at least one selected from the group of: an emulsifying agent, or a surfactant.

The tobacco wax composition is preferably substantially free of separation when stored at room temperature conditions for six months.

The tobacco wax composition preferably comprises 30% to 65% of a vapor agent.

The tobacco wax composition can be contained in a pod.

The tobacco wax composition may be coated on a heated rod.

The pod may have a top porous layer.

The present invention also relates to a combination of the tobacco wax composition and a cartridge, wherein the tobacco wax composition is contained in the cartridge.

The areas of the cartridge in contact with the tobacco wax composition may comprise a material with a surface energy of less than 20 Dynes/cm.

The material with a surface energy of less than 20 Dynes/cm may comprises PTFE or FEP.

The present invention also relates to a system for vaporization of a tobacco wax composition, comprising a device and a pod containing a tobacco wax composition, said tobacco wax composition comprising tobacco wax and at least one vapor agent.

The system may have vapor emissions with TSNA levels below quantifiable limits on a per puff basis, when measured using 55 mL puff/30 sec interval/3 sec duration, and the quantifiable limit is 0.20 ng/puff.

The system may have formaldehyde emissions of below quantifiable limits on a per puff basis, when measured using: 55 mL puff/30 sec interval/3 sec duration, and the quantifiable limit is 0.20 μg/puff.

The system may have vapor emissions of formaldehyde of less than 50%/of the IQOS® HEETS® tobacco sticks comparator, testing using the Canadian Intense smoking regime.

The system may have on off functionality.

The system may have an operating temperature within the range of 160° C. to 240° C.

When sufficiently heated, the tobacco wax composition may have a utilization rate of greater than 80%.

Preferably, the system reaches operating temperature within ten seconds or less, more preferably within five seconds or less, even more preferably within three seconds or less.

In the system, the pod may comprise airholes that align with device airholes.

Preferably, the pressure drop of the system is 75 mm ($H_2O$) to 130 mm ($H_2O$).

In the system, the device may comprise a sleeve.

The system is preferably such that, when sufficiently heated, the tobacco wax composition vaporizers substantially without residue.

The present invention also relates to a method for manufacturing a heat not burn tobacco product, comprising extracting the wax partition from tobacco leaf, and mixing that extraction with a vapor agent. The present invention also relates to a method for manufacturing a heat not burn tobacco product, comprising extracting the wax partition from tobacco leaf, extracting an oil partition form tobacco leaf, and mixing these extractions with a vapor agent.

The extraction method employed may be supercritical $CO_2$ extraction.

The wax partition and the oil partition may be extracted separately from tobacco leaf and subsequently mixed together.

Various aspects of the present invention can be used with compositions other than tobacco wax, including inter alia any botanical wax or botanical oil.

DETAILED DESCRIPTION OF THE INVENTION

Figure 1:
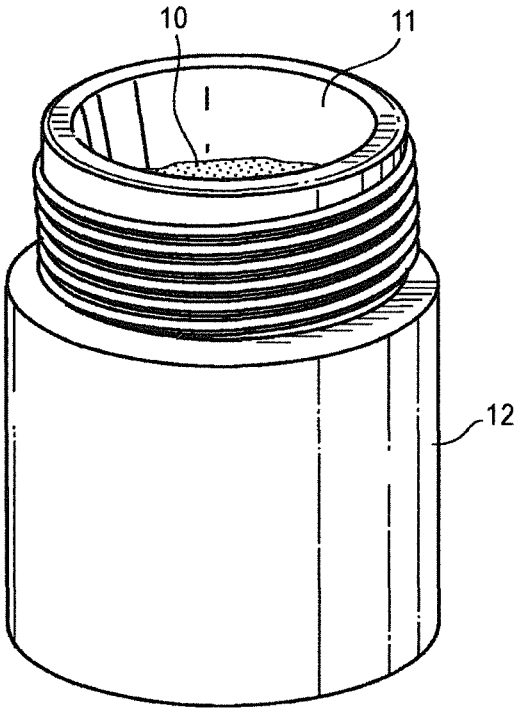
FIG. 1 is a perspective view showing a heating chamber containing a tobacco wax composition.

The present invention reaches a composition that comprises tobacco wax and other ingredients suitable for vaporization and use by a mammal. Applicants have found that the vaporization of a tobacco wax based composition provides excellent organoleptics and nicotine delivery. Moreover, unlike existing heat not burn compositions, applicants have found tobacco wax compositions of the present invention vaporize substantially in their entirety (i.e. substantially without residue). In certain embodiments, it is an object of the present invention to combine such substantial vaporization properties of tobacco wax compositions together with a vaporization system capable of vaporizing the tobacco wax composition in its entirety (i.e. substantially without residue). By vaporize substantially, it is meant that the tobacco wax composition will vaporize substantially without residue when exposed to adequate vaporization temperatures (i.e. greater than 95%, preferably greater than 98%, still more preferably than 99%). The tobacco wax composition may not vaporize entirely in cases where the device fails to adequately heat the tobacco wax composition (for example, when used in a cartridge where tobacco wax composition fails to fully flow to the heating element, resulting in an amount of the composition not being exposed to adequate vaporization temperatures (such failure discussed below as tobacco wax composition utilization).

Tobacco wax based compositions allow for a heat-not-burn tobacco product that is not a readily flowable liquid, and does not require specialized reconstituted sheet production or use, or use conventional tobacco leaf products (like Pax). In certain embodiments, tobacco wax compositions of the present invention may be more or less flowable.

It is an aim of the present invention to allow for a heat not burn tobacco product which does not have, or substantially does not comprise, reconstituted tobacco sheet.

The role of plant wax for plants is understood. Plants secrete waxes into and on the surface of their cuticles as a way to control evaporation, wetability and hydration. The epicuticular waxes of plants are mixtures of substituted long-chain aliphatic hydrocarbons, containing alkanes, alkyl esters, fatty acids, primary and secondary alcohols, diols, ketones, aldehydes. From the commercial perspective, the most important plant wax is carnauba wax, a hard wax obtained from the Brazilian palm Copernicia prunifera.

B. R. Jordan describes tobacco wax as consisting of three major components: straight chain hydrocarbons (C27-C33 comprising 59/); branched-chain hydrocarbons (C25-C32 comprising 38%) and fatty acids (C14-C18 comprising 3%) (Advances in Botanical Research, Vol 22, "UV-B Radiation: A Molecular Perspective, hereby incorporated by reference as if fully set forth herein).

Various processes for extracting wax from plant materials can be employed in connection with the present invention. These extraction methods include, without limitation, sub-critical CO2 extraction; supercritical CO2 extraction; supercritical extraction with additional (non-CO2) solvents; maceration; digestion (a heated form of maceration); decoction; percolation; hot continuous extraction (Soxlet); Aqueous Alcoholic Extraction by Fermentation; Counter-current Extraction; Ultrasound Extraction (Sonication); and the Phytonics Process. This list is non-limitative as skilled artisans will appreciate and other suitable extraction methods may be employed. Solvents used may be polar or non-polar. Various combinations and/or sequential series of these methods can be used.

The non-limitative preferred embodiment is supercritical CO2 extraction. The use of supercritical CO2 extraction to de-nicotinize tobacco is disclosed in Howell et al U.S. Pat. No. 8,887,737 (2014), which is hereby incorporated by reference as if fully set forth herein.

Extraction, including the preferred embodiment supercritical CO2 extraction, can be used to generate several partitions from tobacco, broadly speaking, including oils and waxes. Both of these partitions contain nicotine. The partitions may be extracted separately, or together, depending on extraction set-up. Generally, to extract together, a single separator is used, employing phase transition to extract into the single separator. In other embodiments, two or more separators or used. In such architecture, one separator may be used for wax partition, and other for oil partition. One separator may use sub-critical parameters (with a pressure of 30-70 bar, preferably 35-60 bar), and another separator may use super-critical parameters (with a pressure of 90-170 bar, preferably 100-150 bar).

The wax partition yield should exceed 1% of the starting tobacco weight (or mass), preferably 2% or greater, most preferably 4% or greater. When extracted separately, the oil partition yield should exceed 1% of the of the starting tobacco weight (or mass), preferably 1.5% or greater, more preferably 2.5% or greater. Together, the wax and oil partitions should comprise 3-8% of the starting weight (or mass), or greater than 4% of the starting weight (or mass), or preferably greater than 5% of the starting weight (or mass). Extraction processes may be configured to extract both the wax and oil together in a single partition, with the same sum weight (or mass) described in the immediately preceding sentence.

All forms of tobacco may be used including tobacco leaf, stem, and waste tobacco dust. Blends of tobacco may be employed. Cigar tobaccos may be employed. Tobacco varieties with high nicotine content are preferred, including to minimize processing requirements. Because the extraction process may bring flavors and aromas from the leaf into the wax and oil, the tobacco inputs may be selected in whole or in part for taste. It may be desirable to pre-treat the tobacco prior to extraction with a basic agent (e.g. sodium carbonate) to encourage nicotine extraction from the tobacco.

It is contemplated that the tobacco blending process will be carried out prior to extraction, or after extraction. For example, a blend may be made of one or more tobaccos (e.g. flue cured, burley and Turkish) and extraction made therefrom. Alternatively, the three tobaccos of the prior example may be separately extracted, and blended to taste and other characteristics using the extracted wax partitions (and oil partitions, optionally) of each extracted tobacco type.

It is important to note that extraction techniques to remove the wax partition may also function to extract undesired TSNA's from tobacco. In particular, supercritical CO2 extraction may solubilize TSNA's from the tobacco, concentrating them in the resulting wax and oil partitions.

Since it is desirable to minimize TSNA's in the final product, it is desirable to use tobacco inputs with very low TSNA's. This will result in a product with low TSNA's without the need for optional pre or post processing steps to remove TSNA's from the wax partition. Preferably, the tobacco input have a TSNA level below 3 ppm, more preferable below 2 ppm, still more preferably below 1 ppm, and even more preferably below 0.3 ppm, and most preferably below 0.1 ppm).

It is desirable to minimize pesticide levels in the final composition. Tobacco input may be selected with minimal pesticide levels.

Pre and or post processing steps may be employed to minimize (or increase) undesired (or desired) constituents.

By pre-processing, we mean steps taken to modify the tobacco prior to the extraction process. Such pre-processing steps may involve grinding tobacco to desired size, stripping tobacco stems, treating tobacco with a pH agent, etc.

By post-processing, we mean steps taken to modify the wax and/or oil partitions extracted from the tobacco input.

For example, pesticide levels in the wax and/or oil partitions may be reduced using a variety of methods. One such method is chromatography. Chromatography separation, relying on compound polarity, is an effective method to reduce and/or eliminate undesired pesticide levels or other undesired compounds. Other known separation methods may be so employed in post processing.

By way of example, a B•U•CHI® flash chromatography system, or other suitable equipment, may be employed.

It may be desirable, depending on desired toxicology and national regulations, that the tobacco wax composition will have residue levels at or below the guidance residue levels set forth in Coresta Guide N 1 ("The Concept and Implementation of CPA Guidance Residue Levels) (July 2016 with additional CP added June 2018), which is incorporated herein in its entirety, or below the levels described in the Examples below.

Extraction parameters may impact the nature of the wax partition, including various parameters including flavor, nicotine levels, TSNA levels, and the rheology of the wax partition itself. In certain embodiments, it may be desirable to extract a non-flowable wax partition, or a substantially non-flowable wax partition. The wax partition may be viscous and flowable or somewhat flowable in certain embodiments. The oil partition will be flowable in most embodiments.

It is expressly contemplated that the oil partition may be mixed into the resulting wax partition to increase the yield of wax and nicotine. High shear mixers (and other mixing methods) may be used for this purpose. Preferably, the mass of the oil partition added to the wax partition will be less than or about 75% of the mass of the wax partition, preferably less than or about 30/and most preferably less than 15% of the mass of the wax partition (measured by mass). The oil partition can serve to increase nicotine, enhance flavor, increase vapor production and generally extend the yield from tobacco. However, TSNA levels may concentrate in the oil partition, and so it is desirable to specifically monitor the TSNA level of the oil partition when considering the desired combination of the two partitions. Similarly, other analytes may be considered.

Additional excipients may be employed to develop a final composition for vaporization.

Vapor agents may be added to the wax. In this application, we define a vapor agent as a material that increases the vapor from the wax composition when heated. Vapor agents may include, without limitation, vegetable glycerin, non-vegetable forms of glycerin, propylene glycol, polyethylene glycol, polysorbates including polysorbate 20 (polyoxyethylene sorbitan monolaurate), polysorbate 40 (polyoxyethylene (20) sorbitan monopalmitate), polysorbate 60 (polyoxyethylene sorbitan monostearate) and polysorbate 80 (polyoxyethylene sorbitan monooleate), and other agents suitable for increasing the "vapor" from a heated composition, but "vapor agents" do not include nicotine, typical flavoring agents or tobacco. Vapor agents may be added to about 70% of the composition (by mass), preferably 30-65% of the composition (by mass), most preferably 45-55% (by mass) of the composition. Lower levels, for example 10% and above, of vapor agents may also be employed, resulting in a stronger, more concentrated final composition. Above 60%, the final composition may become too flowable for certain vaporization devices.

In certain embodiments, all or substantially all of the vapor agent employed is vegetable glycerin. This is because vegetable glycerin has a relatively high viscosity, and flowability of the final composition is undesired in certain embodiments. For example, a flowable composition may "spill" out of the heating chamber when a vaporizer is left on its side. Of course, film formers and gelling agents may optionally be employed to increase viscosity as needed.

It should be noted that the wax compositions of the present invention are generally not wickable—or capable of wicking or capillary action at low temperatures. Thus, the device used to vaporize the wax compositions of the present invention is not a conventional e-cigarette in most embodiments.

High shear mixing is important to ensure uniform distribution of the vapor agent (or other added excipient) in the composition. The tobacco wax may tend towards hydrophobicity, which may present mixing challenges. The use of an emulsifying agent may be desired to assist in emulsifying the mixed composition. Without limitation, the following emulsifying agents are examples of emulsifying agents that may be employed: agar, albumin, alginates, casein, ceatyl alcohol, cholic acid, desoxycholic acid, diacetyl tartaric acid esters, egg yolk, glycerol, gums, carrageenan, lecithin, mono- and diglycerides, monosodium phosphate, monostearate, ox bile extract, propylene glycol, soaps, or taurocholic acid (or its sodium salt). As a practical matter, non-glycerol emulsifying agents are preferred. Emulsifying agents may comprise 0.01% to 5% of the tobacco wax composition, or more in certain embodiments.

It is an object of the certain embodiments of the present invention to achieve a tobacco wax composition, including a vapor agent, that is free or substantially of separation. Separation should not occur when stored at normal room temperature (70-80° F.) conditions for a period of three months, preferably, six months, more preferably one year, and most preferably two years.

Similarly, surfactants may be employed in certain embodiments to promote mixing. Surfactants lower tension between a surface and a liquid or between two or more immiscible substances. Anionic surfactants contain anionic functional groups at their head, such as sulfate, sulfonate, phosphate, and carboxylates. Prominent alkyl sulfates include ammonium lauryl sulfate, sodium lauryl sulfate (sodium dodecyl sulfate, SLS, or SDS), and the related alkyl-ether sulfates sodium laureth sulfate (sodium lauryl ether sulfate or SLES), and sodium myreth sulfate. Others include: Docusate (dioctyl sodium sulfosuccinate) Perfluorooctanesulfonate (PFOS) Perfluorobutanesulfonate, Alkylaryl ether phosphates, and Alkyl ether phosphates. Carboxylates are the most common surfactants and comprise the alkyl carboxylates (soaps), such as sodium stearate. More specialized species include sodium lauroyl sarcosinate and carboxylate-based fluorosurfactants such as perfluorononanoate, perfluorooctanoate (PFOA or PFO). Certain surfactants contain cationic head groups. Zwitterionic (amphoteric) surfactants have both cationic and anionic centers attached to the same molecule. The cationic part is based on primary, secondary, or tertiary amines or quaternary ammonium cations. The anionic part can be more variable and include sulfonates, as in the sultaines CHAPS (3-[(3-Cholamidopropyl)dimethylammonio]-1-propanesulfonate) and cocamidopropyl hydroxysultaine. Betaines such as cocamidopropyl betaine have a carboxylate with the ammonium. The most common biological zwitterionic surfactants have a phosphate anion with an amine or ammonium, such and the phospholipids phosphatidylserine, phosphatidylethanolamine, phosphatidylcholine, and sphingomyelins. Many long chain alcohols exhibit some surfactant properties. Prominent among these are the fatty alcohols, cetyl alcohol, stearyl alcohol, and cetostearyl alcohol (consisting predominantly of cetyl and stearyl alcohols), and oleyl alcohol. Surfactants may comprise 0.01% to 5% of the tobacco wax composition.

In certain embodiments, a wetting agent may be employed. A wetting agent is a surfactant that, when dissolved in water, lowers the advancing contact angle, aids in displacing an air phase at the surface, and replaces it with a liquid phase. Examples of application of wetting to pharmacy and medicine include the displacement of air from the surface of sulfur, charcoal, and other powders for the purpose of dispersing these drugs in liquid vehicles; the displacement of air from the matrix of cotton pads and bandages so that medicinal solutions can be absorbed for application to various body areas; the displacement of dirt and debris by the use of detergents in the washing of wounds; and the application of medicinal lotions and sprays to surface of skin and mucous membranes. Wetting agents may comprise 0.01% to 5% of the tobacco wax composition.

Polysorbate (Tween) is a nonionic surfactant and emulsifier that is particularly useful in connection with certain embodiments of the present invention. Various Tweens can be used, including inter alia Tween 20 and Tween 80.

Tobacco leaf may be added to the wax composition, in any known form, including without limitation shreds, dust, particles and the like. Said tobacco leaf may be leaf from which the tobacco wax was extracted in certain embodiments. Tobacco leaf, including reconstituted tobacco leaf, may be present from 0.01 to 30% mass of the composition in certain embodiments. Adding tobacco leaf to the composition can provide a look and feel of the product akin to Shisha tobacco. Certain embodiments may be treated, as a regulatory matter, as Shisha.

The nicotine content of the final tobacco wax composition is preferably less than 12%, more preferably less than 7.5% and most preferable less than 4%. Certain embodiments will have a nicotine range of 1.5-5.5%, preferable 2.5-4% (by mass). Low nicotine compositions with nicotine less than 1.5%, or even less than 0.5% may also be made for users seeking lower nicotine delivery. Nicotine, natural or synthetic, may be added where the tobacco extraction yields a less than desired level. The product can be made from low-nicotine containing tobacco to achieve a low nicotine level, or otherwise subject to known processes to de-nicotinize the extractions or starting input tobacco. In certain embodiments seeking a low nicotine level, no oil partition is used.

Flavors may be added to the wax. Flavors may be synthetic or natural. For purposes hereunder, menthol, wintergreen, peppermint and similar oils used in menthol tobacco products are understood to be flavors, together with traditional flavors (e.g. grape, cherry etc). Menthol crystals may be employed. Tobacco flavors, and traditional tobacco top flavors may be used to impart a rich tobacco flavor. Sustained release flavors, coated particle flavor systems, and flavor capsules with volatile flavors may all be employed. Flavors may comprise 0.25% to 20%, preferably 2.5% to 12.5%, more preferably 2.% to 4.5% of the final composition. Special concern should be paid to miscibility and successful homogenization of the flavor with the wax composition.

Ball bearings, or analogous mechanical means may be used for mixing in a pod including a cartridge.

Penetration agent(s) may be added to the tobacco wax. By penetration agents, we mean an agent that promotes transfer of the active—i.e., a substance that enhances absorption through the mucosa, mucosal coating and epithelium. Penetration agents are known from U.S. Patent Application Publication No. 2006/0257463 A1, the content of which is incorporated herein by reference. The penetration agent may comprise but is not limited to polyethylene glycol (PEG), diethylene glycol monoethyl ether (Transcutol), 23-lauryl ether, aprotinin, azone, benzalkomin chloride, cetylperidium chloride, cetylmethylammonium bromide, dextran sulfate, lauric acid, lauric acid/propylene glycol, lysophosphatilcholine, menthol, methoxysalicylate, oleic acid, phosphaidylcholine, polyoxyethylene, polysorbate 80, sodium EDTA, sodium glycholated, sodium glycodeoxycholate, sodium lauryl sulfate, sodium salicylate, sodium taurocholate, sodium taurodeoxycholate, sulfoxides, and various alkyl glycosides or, as described in U.S. Patent Application Publication No. 2006/0257463, bile salts, such as sodium deoxycholate, sodium glycodeoxycholate, sodium taurocholate and sodium glycocholate, surfactants such as sodium lauryl sulfate, polysorbate 80, laureth-9, benzalkonium chloride, cetylpyridinium chloride and polyoxyethylene monoalkyl ethers such as the BRIJ® and MYRJ® series, benzoic acids, such as sodium salicylate and methoxy salicylate, fatty acids, such as lauric acid, oleic acid, undecanoic acid and methyl oleate, fatty alcohols, such as octanol and nonanol, laurocapram, the polyols, propylene glycol and glycerin, cyclodextrins, the sulfoxides, such as dimethyl sulfoxide and dodecyl methyl sulfoxide, the terpenes, such as menthol, thymol and limonene, urea, chitosan and other natural and synthetic polymers. Preferably, the penetration agent is selected to be capable of transfer through vaporization.

Buffer agents may be added to the tobacco wax, including without limitation to create static or a dynamic buffer systems. Preferably, the buffer agent is used to raise the pH of the mouth in order to increase nicotine absorption in the buccal cavity in a manner which is based on pka and the Henderson Hasselbach equation. For nicotine, preferably, the pH of the mouth is increased to 7 to 10, preferably 7.8 to 10, most preferably from 8.5 to 9.5. Preferably, the buffer agent increases the pH of the oral cavity for a period of ten minutes or more after administration Buffering agents may be used to control pH, including without limitation, sodium bicarbonate, potassium bicarbonate, sodium carbonate, potassium carbonate, calcium carbonate, dipotassium phosphate, potassium citrate, sodium phosphate and any other such buffer system. The buffer system may be designed to dynamically control the pH of the product taking into consideration the effect of saliva during use, i.e., a dynamic buffer system. Examples of buffer systems to obtain the preferred pH include dibasic sodium phosphate and monobasic sodium phosphate. Both are FDA accepted buffer materials used and listed in the inactive ingredients list. For example, for a pH of 7, the ratio of monobasic/dibasic can be 4.6/8.6; for a pH of 7.5 the ratio of monobasic/dibasic can be 1.9/11.9; and for a pH of 8.0 the ratio of monobasic/dibasic can be 0.6/13.4. These are mathematically calculated buffer numbers and will need to be adjusted according to the other ingredients added to the formula. Thus this dynamic buffer range is adjusted by the amounts of the buffer system since saliva is freshly renewable in the mouth. See U.S. Patent Application Publication No. 2009/0098192 A1 by Richard C. Fuisz and U.S. Patent Application Publication No. 2011/0318390 A1 by Richard C. Fuisz et al. discussing dynamic buffering and incorporated herein by reference.

Nicotine salts may be employed in certain embodiments. This involves complexing nicotine with an acid, to form a salt. Suitable acids may include without limitation: pyruvic acid, salicylic acid, sorbic acid, lauric acid, levulinic acid, or benzoic acid. U.S. Pat. No. 9,215,895 (Nicotine salt formulations for aerosol devices and methods thereof) and US 20080241255A1 (Device and method of delivery of a medicament) are hereby incorporated by reference as if fully stated herein. In a preferred embodiment, the extracted nicotine oil is complexed with an acid and then mixed with the wax partition. The nicotine salt may also be mixed with glycerin and then mixed with the wax. In still other embodiments, the acid is complexed with the wax partition to form the salt.

Crystallization inhibitors may be employed, including inter alia to avoid precipitation of the nicotine salt when the acid is complexed with the nicotine. Crystallization inhibitors are described in US 20160038406 (Chemically stable and oromucosally absorbable gel compositions of a pharmaceutical active agent in a multi-chambered delivery system), which is incorporated herein by reference as if fully stated.

Preservatives may be added to the tobacco wax to preserve freshness and inhibit microbial growth.

A pasteurization process step may be employed, inter alia, to prohibit microbial growth. The tobacco may be pasteurized prior to extraction, or the extracted partitions themselves may be subject to pasteurization.

Preferably, the composition maintains a relatively high viscosity and/or consistency despite the addition of any excipients. It may be advantageous that the tobacco wax composition does not readily flow until under heavy-vaporizing heat. However, it may be beneficial to adjust the rheological properties of the tobacco wax composition. For example, a reduced viscosity and or surface tension may be desired for various reasons, such as packaging convenience (e.g., a squeezable tube may be easier to use with reduced viscosity). The use of PG as a vapor agent may serve this purpose, having a much lower viscosity than vegetable glycerin. Viscosity may be marginally affected by ambient temperature, and some consideration must be given to same.

It may also be beneficial to increase viscosity, for example to prevent flow off a flat heating surface (e.g. a hookah platform. Etc.). Rheology agents may be employed to adjust the viscosity, surface tension and other rheological properties of the final product. Suitable excipients including film formers, gelling agents, and surfactants. In certain embodiments, film formers are used 0.01%-20%, gelling agents are used 0.01%-20%. Where film formers and gelling agents are employed, a solvent may be used and then substantially removed as appropriate.

Viscosity of one, non-limitative embodiment of the present invention is discussed in Example T below. As discussed in example T, this embodiment presents as a very viscous, non-Newtonian, pseudoplastic (shear thinning) and thixotropic liquid. Viscosity of liquid embodiments is preferably greater than 8000 centipoise, more preferably greater than 10,000 centipoise, and most preferably greater than 12,500 (measured at 2.5 rpm, 25.4° C. using a BROOKFIELD™ viscometer as per Example T below).

The properties of a thixotropic and/or pseudoplastic liquid may desired in certain embodiments to provide structure in the composition, and stability of suspension and/or emulsion of other constituents.

The resulting wax composition may be used by itself, or mixed with other vaporizable compositions both solid and liquid formats. Such mixing may be done by the manufacturer or by the user. Liquid formats including without limitation e-liquid type products. Solid formats include without limitation other waxes from tobacco or other plant or botanical materials. Mixing can also take place by blending the plant or botanical materials which are subjected to the extraction process.

The wax composition of the present invention is intended to be vaporized. Suitable devices include any device capable of sufficiently heating the composition to cause it to vaporize and still not substantially burn the composition. Non-limitative examples of suitable devices include devices marketed as dry herb vaporizers. Suitable temperature ranges for the vaporizer heating element range from temperature needed to vaporize the composition and below the auto ignition temperature of the composition. Cartridge pens vaporizers may be employed.

Suitable battery parameters ranging from 1 Amp continuous output to 30 Amp continuous output.

The wax composition of the present invention is substantially vaporizable, meaning that it will be substantially vaporized when heated in a suitable device. It is desirable in certain embodiments that residue is minimized, including inter alia to avoid the need to clean the device between uses. Where a pod (including a cartridge) is used, residue is of less concern, since the pod is removable regularly replaced by the user, typically after the pre-filled portion of tobacco wax composition has been substantially or fully used.

The tobacco wax composition of the present invention when vaporized, emits lower levels or harmful or potentially harmful constituents (HPHC's) than conventional tobacco products, e.g. cigarettes. The tobacco wax composition, when used in a suitable vaporizer, results in less than 25%, on average or for an individual HPHC, of the levels of HPHC's from a Kentucky reference cigarette (3R4F) (using comparable methods to measure e.g. Health Canada intense method, or ISO 3308:2000, or Massachusetts, or FTC), preferable less than 10% and more preferably less than 5% and even more preferable less than 1%. HPHC's so measured, may include without limitation, each of the 93 constituents identified by US FDA (April 2012) and available at the time of filing at this link:
www.fda.gov/TobaccoProduce/Labeling/RulesRegulationsGuidance/ucm297786.htm.

It is an object of certain embodiments of the present invention to yield HPHC levels that are substantially below those of the IQOS system with a full flavor Heet, on an individual basis, or taking together as an average, or any average basket of all of or any group of, the following enumerated analytes (such sole analyte or basket, the "comparator"). Representative HPHC's may include, inter alia, Acetaldehyde, Acrolein, Acrylonitrile, 4-Aminobiphenyl, 1-Aminonaphthalene, 2-Aminonaphthalene, Ammonia, Benzene, Benzo[a]pyrene, 1,3-Butadiene, Crotonaldehyde, Formaldehyde, Isoprene, NNN, or NNK, as well as the other HPHC's identified by US FDA (April 2012) and identified by the reference in the preceding paragraph. The tobacco wax composition may yield HPHC levels that are at least 30% lower than IQOS-Heet comparator, preferably, 50% lower, still more preferably 75% lower, and most preferably 90% lower. Such comparisons may be made using any known smoking regime, including ISO 3308:2000, Health Canada intense, Massachusetts, FTC, etc. Applicants note that as yet, no standard "reference cigarette" exists for the heat not burn category.

Ideally, as disclosed in the examples, toxicants measure below quantifiable limits. It is desirable to mitigate the levels of tobacco specific nitrosamines (TSNAs) in the composition. The tobacco wax composition has TNSA levels preferably less than 10 parts per million (ppm), more preferably less than 3 ppm, more preferably less than 1 ppm, yet more preferably 0.5 ppm and most preferably below quantifiable limits at the limits of quantification described in the examples below. As shown in the examples, when vaporized the emissions of the tobacco wax composition may result in TSNA levels below quantifiable limits.

Inventors have discovered surprising results in emissions testing of a tobacco wax composition, in the form negligible levels of formaldehyde, which has been associated with the relatively low heating temperatures of heat not burn products. In another aspect, the present invention relates to a portion-sized container ("pod") of a tobacco wax composition for administration to a mammal or person. The pod is intended for use in a personal (or other) vaporizer.

The pod is most commonly in a cup like shape. The top is commonly open, and temporarily covered by a covering that is removed just prior to, or in connection with use of the portion sized container.

By portion-sized, the portion may be for multiple uses and sessions by the user. The tobacco wax composition portion may range from 1 mg to 3 grams, preferably from 250 mg to 2 grams, most preferably 400 mg to 1.2 grams.

In certain embodiments, the pod is received, or mated to a receiving chamber. The receiving chamber comprises—or is adjacent to—the heating system. The receiving chamber and pod are shaped to maintain close contact, with the absence or substantial absence of air between the two respective surfaces (so the pod surfaces are substantially in contact with the receiving chamber). This promotes heat transfer from the receiving chamber to the pod.

In certain embodiments, the receiving chamber comprises a ceramic type material (e.g. porcelain or ceramic). In certain embodiments, the ceramic type material is a positive temperature coefficient (PTC) ceramic, allowing the receiving chamber itself to serve as a heating element or heat source.

In certain embodiments, the PTC ceramic (or comparable receiving chamber material) is composed such that the Curie point discourages or retards heating of the tobacco wax composition above a high (upper) threshold.

In another preferred embodiment, heating element(s) are coated and/or printed (or otherwise applied) directly onto the ceramic heating chamber. Such an approach enables various heating element patterns and shapes to readily be made, which will generally be optimizes for desired heating characteristics (e.g. even heating, speed of heating). Such application of the heating element may similarly be performed on non-ceramic heating chambers.

In certain embodiments, the receiving chamber itself is a comprised of heating elements. For example, the receiving chamber may be comprised of a bottom heating element which mates to the bottom of the pod, and one or more heating loops that hold in place the higher portions of the pod.

In certain embodiments, the pod is a cartridge which comprises a heating element.

High threshold temperatures may be associated with toxicant and degradant production and are to be avoided regardless of the method in which the receiving chamber, pod or cartridge is heated. It is preferable that the tobacco wax composition in the cartridge or pod not be heated to greater than 400° C., preferably less than 350° C., more preferably less than 300° C., more preferably less than 275° C., still more preferably less than 240° C. Relatively low temperatures may be employed given the propensity of the tobacco wax composition of the present invention to vaporize. In the preferred embodiment, an upper threshold temperature is not exceeded, or not generally or likely to be exceeded in normal consumer use. An optimal temperature range (low to high) may be 160° C. to 240° C., preferably 180° C. to 240° C., more preferably 200° C. to 220° C., for certain embodiments of the present invention.

At the same time, it is desirable that that the device be capable of rapidly reaching operating temperatures (without overshooting target operating temperatures or exceeding high threshold temperatures), or otherwise sufficient temperatures. Preferably, the device is capable of heating the tobacco wax composition in the cartridge or pod reach the preferred operating temperature range rapidly, meaning in less than 10 seconds, preferably in less than 3 seconds, more preferably in less than 1 second, and most preferably within 0.5 second. It is contemplated that substantial vapor can be produced for the user within these time intervals.

In certain embodiments, the device has a warm up phase of ten seconds or less, with subsequent puffs being achieved more rapidly. Multiple preheat cycles may be employed on the same pod in the event that the user does not consume the product in one event.

As shown in Example P, below, a cartridge was able to vaporize the tobacco wax composition very effectively, with "on off" functionality—meaning there was no discemable time lab from the time the device was activated from inhalation (suction) and the production of vapor.

By "otherwise sufficient temperatures," applicants refer to temperature at which the tobacco wax composition readily vaporizes.

In contrast, the leading commercial heat not burn product, PMI's IQOS® system, requires approximately 20 seconds for the IQOS® device containing the heat stick, to reach operating temperatures (see IQOS® operating instructions, available here: /www.pmiscience.com/sites/default/files/appendix_3_-_ths_safety_warnings_and_instructions.pd). After reaching operating temperature, the entire heat stick must be used within "approximately six minutes" (id). Moreover, the IQOS® device must be recharged in its charging case after each use: "After each session your IQOS holder must be recharged" (id). The IQOS® holder has a larger battery capacity. Again, according to the same source, "The IQOS pocket charger can recharge your IQOS holder up to 20 times before it must be recharged itself" (id). Again per the operating instructions, each HEATSTICKS® tobacco rolled in a stick tube provides approximately fourteen puffs (id). Because the HEATSTICKS® tube comprises reconstituted tobacco that is pierced by the IQOS® heating blade, when heated the reconstituted tobacco will tend to lose plasticity, and may adhere or otherwise crumble into or stick to the IQOS® device after use. Accordingly, IQOS® provides extensive instructions on how to "release any Heatstick fragments" (id).

This description of IQOS provides a number of difficulties for a user: the need to wait twenty seconds for the device to reach operating temperature; the need to consumer the entire heat stick within six minutes, need to recharge from the larger battery back (the "holder") every fourteen puffs.

It is an object of the present invention to traverse these issues in the heat not burn category by allowing virtually instant vapor from the tobacco wax composition, and to allow a vapor pen device using a standard on-off heating scheme. Similarly it is an object of the present invention to substantially eliminate the need to clean the device.

While ignition of the tobacco wax composition is unlikely, it is an express intention that the tobacco wax not be ignited or otherwise burned by or in the device in most embodiments. A review of the emissions data contained in the examples below, including the absence of toxicants, confirms that the tobacco wax composition of the present invention experience substantially no combustion at temperatures sufficient to vaporize the tobacco wax composition. In the examples, sufficiency of temperature to vaporize the tobacco wax composition is evidenced by the mass-loss during the puff emissions tests.

It is an object of certain embodiments of the present invention to avoid combustion of any material, including inter alia tobacco, tobacco wax and tobacco oil.

It is an object of certain embodiments of the present invention to avoid or substantially avoid emission of carbon monoxide.

It is an object of certain embodiments of the present invention to be a heat not burn product that does not comprise tipping paper.

It is an object of certain embodiments of the present invention to be a heat not burn product that is not a cigarette.

Airflow is an important feature of a vaporizer system, for the user experience.

In many embodiments, it is desirable to have no or effectively no bottom airflow into the cup. Bottom airflow is the primary design currently used in cigarettes and vapor pens. Bottom airflow directs air directly over the heating coil (where vapor is created). The wick for e-liquid helps to prevent leaking of the e-liquid.

In a system for the tobacco wax composition, wicking is generally not possible. The tobacco wax composition will simply not wick as a conventional e-liquid will. Moreover, an unplugged bottom hole is problematic with tobacco wax in certain embodiments. This is because hot wax may tend to leak down, re-solidify and clog the bottom airflow (leakage of a conventional e-liquid in a convention tank is unpleasant but does not clog the device in a disabling manner). Moreover, the now solid tobacco wax is fairly difficult to remove. Side airflow, and/or top airflow is less likely to clog and is thus preferred (either in whole, in part, or substantially). Top airflow has the benefit that it is the least likely set up to clog.

In both top and side airflow, turbulence is relied upon to mix air currents with vapor, since the prevailing airflow is towards the mouthpiece (and the vacuum created by the user's inhalation).

In the present invention, the tobacco wax composition containing pod is heated. Vapor forms—often at the bottom and sides of the pod closest to the heat, and the wax product is vaporized (and climbs through the top of the wax product).

The closer the airflow is to the top of the tobacco wax composition product, the easier it is for turbulence to join the vapor into the prevailing airflow. Thus it is desirable to have side airflow occur in relatively close proximity to the top of the composition product level. However, if the side airflow is too close to the top of the composition product level then the side airflow holes will be more prone to blockage.

Side airflow may enter through the sides of the pod. In this embodiment, the pod itself has holes that correspond to side airholes located in the sides of the receiving chamber (and permitting airflow, being connected to the outside of the vaporizer). Such side holes in the pod are covered prior to use (to protect the product), and such cover is removed by the user prior to use or automatically by the device.

It is also possible for the device to create side airholes in the pod material (as opposed to removing the covering from pre-formed airholes), where a relatively weak material is used that can be readily punctured.

The side airflow must enter above the tobacco wax composition product fill level (as distinct from the top of the pod).

The product fill level must be calibrated to the location of the side airholes, if any, in the sides of the pod. Side airflow (and airholes) may also enter from the side of the receiving chamber above the top of the pod. Where there are side airholes above the top of the pod, similarly the product fill level is still calibrated to the distance from the product fill to the airholes. If the distance is too short, blockage is more likely. Similarly, if the distance is too long vapor production will be lessened. In certain non-limitative embodiments, the side airholes are less than 4 mm from the starting product fill level, preferably less than 2 mm from the starting product fill level, preferably more than 0.5 mm from the starting fill level, more preferably more than 1 mm from the starting fill level.

Side airholes may be directed downwards (i.e. at a downwards trajectory) to increase the air vortices and turbulence.

Airholes may be protected from wax blockage in a number of ways. First, a physical obstruction may be employed (e.g. a physical lip). Such physical obstructions can make it harder for melted wax to flow into the airhole (particularly when the user physically moves the pen during use—for example, starting with a vaporizer perpendicular to the flow and then moving the vaporizer to a parallel position for use). Similarly, materials (including coatings) may be selected to minimize or direct the flow of liquid wax away from the airholes to prevent blockage. Physical channels (e.g. grooves) may be similarly employed to direct the flow if liquid wax away from the airholes.

Placement of airhole locations can be oriented to avoid or reduce blockage. Typically, the personal vaporizer may be raised to mouth of a user and held parallel to the ground when used. However, in a conventional vaporizer, there is no way to predict how the vaporizer will be oriented by the user. A conventional heat button can be readily used by the thumb or an opposing finger, and is not a good predictor for orientation (although the user will typically have the battery button pointing up or down). The mouthpiece however can be shaped in such a way that is intuitive to the user to orient the vaporizer in a certain direction (as a non-limitative example, a plastic cigarillo tip is typically formed in a way that a user would know how to orient the cigarillo). In this embodiment, the side airholes can be oriented such that the airholes are biased to the upwards plane when the vaporizer is oriented parallel to the ground plane (since we know how the user will orient the vaporizer because of the mouthpiece. For example, three airholes may be used (in the receiving chamber potentially with aligned pod holes) that are positioned with a bias against the downward side (meaning the airholes are biased towards the upward side when the device is uses as expected including through use of a shaped or marked mouthpiece).

The vaporizer, pod and/or receiving chamber may have up to ten side airholes, preferably 2-6 side airholes most preferably 3-5 side airholes. Where a mesh or similar covers the airhole opening, the number of airholes would be understood to be the number of air channels.

The device may similarly be marked or shaped on a part of the device other than the mouthpiece to indicate a desired orientation (with corresponding placement of airholes as described above to reduce blockage potential). For example and without limitation, shape indentations may be provided to signal a desired holding of the device in the hand.

In certain non-limitative embodiments, the pod has a diameter of 3-15 mm, preferably 6-10 mm (with a corresponding internal diameter for the receiving chamber).

In certain non-limitative embodiments, the pod has a height of 0.5 to 22 mm, preferably 2 to 10 mm (with a corresponding size for the receiving chamber).

In certain embodiments, the pod itself may comprise the heating chamber, optionally including the heating element as a component of the pod. While this embodiment may be more costly to manufacture (as compared with a pod that merely mates with a heating chamber), such embodiment offers the advantage of providing a fresh heating elements with each pod. Such advantage may be associated with increased puff consistency since degradation of the heating element is avoided through less use (i.e. replacement or substantial replacement with each new pod).

Heated tobacco wax compositions in a pod can be explosive (in terms of physical motion—not ignition) when wax at the bottom of a pod is vaporized, and the vapor pressure is such as to disrupt the wax above to allow the vapor to escape. It is desirable to have a "shield"—a physical obstruction that prevents direct passage of heated tobacco wax composition material from the pod or cup to the mouthpiece. Generally the shield is attached to the mouthpiece (but it may equally attach to other parts of the vaporizer). The shield may also employ features intended to increase airflow turbulence, without adversely affecting the user's "draw" on the vaporizer.

The Pod may similarly be designed to minimize the possibility of wax explosions. For example (and without limitation), a rim or brim on the pod may act in the same manner as the shield to obstruct wax explosions from traversing the mouth piece.

The pod-receiving chamber may have a rail, slot or comparable alignment interface to ensure the pod is appropriately aligned in the receiving chamber, including for other reasons, so that the airholes from the receiving chamber align or substantially align with the pod airholes. In this embodiment, the pod has complimentary features to mate with the alignment interface. Such alignment may also be used for other purposes, i.e. to facilitate other connections between pod and receiving chamber (e.g. data link, ejector system, etc).

The vaporization device may have an ejection system to facilitate ejection of the pod from the receiving chamber (as opposed to relying upon shaking or use of inertia to evacuate the pod). Such system may comprise, without limitation, a physical ejector to lift the pod out of the receiving chamber.

A mouthpiece sits above the pod-receiving chamber assembly. The mouthpiece employs a combination of distance and relatively low heat transfer properties to ensure the mouthpiece is not uncomfortably warm for the user. The mouthpiece may be integrated with a shield and/or a device to increase turbulent airflow.

Distinct from the concept of the shield described herein, certain embodiments will have a sleeve designed to ease cleaning of the mouthpiece. Wax may form on the inside mouthpiece during use of the material, either from explosion of wax or from condensation of materials. Such remainder wax may be unsightly and require manual cleaning. In certain embodiments, a sleeve may be shaped such that it adheres or substantially adheres to the mouthpiece. The sleeve may be disposable, allowing a user to simply dispose of the sleeve (rather than cleaning the mouthpiece), akin to a disposable coffee filter. The sleeve may comprise any suitable material, including without limitation, a paper, pressed paper, cardboard, a cellulosic, or other suitable material. The selected material for the sleeve should resist formation from air vortices, or from trapped wax or condensate. The sleeve material may be coated. Coatings may be designed (and sleeve materials selected) to resist adhesion of wax (to encourage the adhered material to drop back to the heating chamber), or to encourage adhesion. Encouraging adhesion may useful to avoid contact of the user with condensate when removing the sleeve. The sleeve may be absorbent to better catch the wax or condensate.

A reusable sleeve may also be employed in certain embodiments. In such embodiments, the sleeve may be removed, cleaned, and replaced. For such reusable embodiments, any suitable material may be employed that can be readily re-used.

For embodiments for which the mouthpiece can be used with a sleeve, the mouthpiece must be capable of being easily placed into the mouthpiece, as well as capable of being readily released by the user for disposal or cleaning. A latch or locking mechanism may be employed. In some embodiments, the sleeve is held in place by simple screwing the mouthpiece onto the heating chamber. Preferably, the sleeve can be released in less than 5 seconds by the user, preferably in less than 2 seconds, most preferably in less than one second.

The sleeve may be any suitable color. In certain embodiments, a shade of brown may be used to better mask the appearance of the adhered or trapped wax. In general, but without limitation, dark colors are preferred.

In certain embodiments, the pod itself may be fashioned from a material that heats, e.g. a PTC ceramic. Other materials may also be used that heat when electric current is supplied. In this embodiment, the receiving chamber acts as a physical receiving area, may provide airflow (airholes) and may integrate power to the pod. The pod may further comprise a thermistor to measure temperature, either of the pod itself or wax contained therein.

Empty pods may also be offered to allow the user to treat the device as an open system (meaning they can use their own vaporizable materials).

The pod may be made from any suitable material. Special care must be given that the pod material does not emit undesirable elements when heated. The material will generally be a solid material, but flexible materials may also be employed. In a cartridge system, a flexible bladder or chamber may be employed. In certain embodiments this flexible bladder may assist to promote flow of the tobacco wax composition towards the heating element.

While a pod with a flat or substantially flat bottom surface is desirable for handling by the consumer, other shapes may be used. Specifically, a shape whereby the cup is half a circle will mean reduce mean geographic distance from the receiving chamber walls. Other shapes can be selected with this same purpose, i.e. to reduce geographic distance. Corners may, ceteris paribus, create higher heat areas within the tobacco wax contained in the pod.

In certain embodiments, the pod may be integrated with the sleeve function. For example, the pod may be in the shape of a circular cauldron—which is heated—connected to an upper conical shape that prevents the mouthpiece from getting wax or wax condensate adhered. In such embodiments, the pod may be comprised of multiple materials—the lower portion designed for heating, and a separate upper material that is designed to function as a sleeve. In some embodiment, it may be desirable to have a separating material between the heatable portion of the pod and the sleeve portion. It in cases where adequate power is available, the design may allow the sleeve to heat. Such heat may be useful to reduce adhered wax composition.

In certain embodiments, a v-shape may be used to flow wax towards the heating element. By v-shape, we refer to the use of slope to employ gravitational flow of the tobacco wax composition.

In certain embodiments, the top of the pod is covered with a porous layer which remains on top of the pod during use. This porous layer is sufficiently porous to allow for transmission of sufficient vapor for the user. The porous layer is similarly sufficiently porous not to interfere or prevent a desired pressure drop.

In certain embodiments, the pressure drop of the device used to vaporize the tobacco wax composition, inclusive of the pod if any, will have a pressure drop of 20 mm ($H_2O$) to 175 mm ($H_2O$), preferably 75 mm ($H_2O$) to 130 mm ($H_2O$), most preferably 90 mm ($H_2O$) to 110 mm ($H_2O$). Pressure drop is measured using Coresta Guide No. 4, or other accepted method for measuring pressure drop.

The porous layer is sufficiently non-porous to prevent (or substantially prevent or partly prevent) parts of the wax composition from exploding upwards and escaping from the heating chamber to whence they may adhere to the mouthpiece.

The porous layer may be made from any suitable material. In certain embodiments, a thermo-conductive material is used, such that the permeable layer. Thermo-conduction may be used to encourage parts of the wax composition that are caught or trapped on the permeable layer to drip off and re-join the wax composition in the heating chamber (and/or themselves be vaporizer).

In certain embodiments, the porous layer may be selected or coated so as to resist adhesion of wax composition components to the layer.

In certain embodiments, the porous layer includes heating element(s).

In certain embodiments, the top of the pod is covered with two layers. The outer layer is an impermeable or semi-impermeable layer for barrier purposes (i.e. product stability and freshness) (a "barrier layer"). Underneath the outer layer is the porous layer which remains on during use.

In certain embodiments, porous materials—akin to those described for the porous top layer, may be used to cover side-holes or other airholes.

The top of the pod may be configured to allow for easy access by a consumer. This allows a consumer to add other waxes or extracts to the pod. Conversely, the system may be configured to make it difficult for a consumer to add their own materials to the pod.

A temperature meter can be built into the pod (including without limitation a cartridge), the receiving chamber, or both. The pod and receiving chamber are used as part of a vaporizing system, further comprising a power source (typically electric, but it may also be a carbon-based source, or butane based source or other source of heat), and a control module that allows the user to select heat settings, turn the device on or off, as well as other features. The device may be able to store and communicate use data.

A temperature meter in a cartridge may be particularly useful for embodiments that employ a warming cycle as discussed below.

The pod may be able to communicate to the device (or the device determine from the pod) the type of pod (flavor, quantity of tobacco wax composition, nicotine strength, etc.).

It will be appreciated that the use of a pod will give additional flexibility to the wax composition formulation, because non-vaporizable ingredients may be used in the composition without leaving the non-vaporizable ingredients as residue that require cleaning by a user. Film formers or molasses (and other sugars and sweeteners) are non-limitative examples of non-vaporizable ingredients that may be employed.

The use of the pod is not limited to tobacco wax compositions but may also be employed with other botanical or plant wax compositions, as well as e-liquids. Such materials may be used in combination with tobacco wax. References herein to tobacco wax compositions can also refer to these products and compositions comprising them.

One potential negative with the pod may be the availability of too much tobacco wax composition for vaporization when vaporization temperature is reached, particularly where the temperature is not effectively controlled. This can result in puffs where are too strong—both organoleptically and also unequally. Unequally meaning a variance in strength and emissions puff to puff. Generally speaking, such variance is undesirable.

The tobacco wax composition may be coated on a heated rod, or other substrate. The direct contact with the heated rod (or other substrate) allows for rapid heating. The substrate may be shaped as a rod, or other shape (for example, and without limitation, a rectangle, folded rectangle)

In certain embodiments, the pod may use a matrix material to trap the tobacco wax composition. Such matrix may be metal or non-metal. In certain embodiments, an organic or synthetic cotton is used that can trap the tobacco wax composition. As the tobacco wax composition is heated, and becomes flowable, it leaves the cotton and is available for vaporization. The use of a matrix in the pod (or other chamber, such as a cartridge) may be useful in certain embodiments to promote puff to puff consistency (i.e. reduce puff strength variability). Obviously, it is important that the matrix material does not leach impurities into the tobacco wax composition. In certain embodiments, a metal matrix may be desirable for heat transfer.

Some distinctions in heat transfer are important to understand in connection with various embodiments of the present invention. In IQOS® and British American Tobacco (Brands) Limited's GLO®, the tobacco stick (comprising reconstituted tobacco) requires airspaces in the reconstituted tobacco stick to allow for the aerosolized components to travel from the reconstituted sheet and out through the mouthpiece. Were such air spaces absent, and the tobacco stick comprised of a solid reconstituted plug, it would be extremely difficult (and require substantial heat) to force the aerosol through the solid plug. As a practical matter, only components on edge of a solid plug would successfully vaporize. This can be seen as analogous to oral thin film casting, wherein water can get trapped in a polymeric matrix and become difficult to remove through heating.

The IQOS® device has an operational temperature of 350° C.; in contrast the GLO® vaporizer uses has a lower operating temperature of 240° C. This difference in operating heating temperatures can likely be explained by the different heating configurations of the two devices. IQOS® employs a flat, thin, heated blade or knife upon which the tobacco stick is impaled. The knife does not reach the outer edges of the heat stick (tobacco stick) (otherwise it would destroy the tipping paper on the outside of the tobacco stick). Approximately, it can bethought of as having the width of 0.8 of the tobacco stick. In contrast, GLO® reportedly heats from the circumference surrounding the tobacco stick. Assuming a heating element of the same length, the circumference approach has greater surface area (circumference*length). Assuming a diameter of 1, and identical length, the GLO® approach offers a surface heating area of 1*3.14, as opposed to two sides of the flat blade (0.8*2=1.6). This greater surface heating area (again assuming identical lengths) likely explains in part the lower operating temperature of the GLO® system.

However, in both GLO® and IQOS®, heat is required to travel through airspaces. Air must be drawn in by convection current to be heated, and air is understood to be a very poor heat conductor. Heat transfer by air convection is an essential component of both IQOS® and GLO®. The use of air convection, together with the relative difficultly of aerosolizing components from a solid matrix, helps to explain the relatively long warm up period for these products (20 seconds) and relatively high operating temperatures.

In contrast, the tobacco wax of the composition has no or substantially air spaces. In various embodiments, it is a solid, semi-solid or viscous liquid. All of these embodiments substantially lack air spaces. The result is that the tobacco wax composition has efficient heat transfer attributes. Glycerin and propylene glycol both have excellent heat transfer properties (sufficiently good for use in anti-freeze systems), as does the tobacco wax itself. The tobacco wax composition is heated in preferred embodiments with the absence or substantial absence of air convection to heat the tobacco wax composition.

In certain embodiments, the tobacco wax composition of the present invention has a thermal conductivity at 300° K (80.3° F.) of greater than 0.1, preferably greater than 0.2, more preferably greater than 0.25 (W/m K).

The substantial absence of air in the tobacco wax composition may also serve to prevent or reduce oxidation when the tobacco wax composition is heated.

The positive organaleptics, the ability to achieve strong vapor outputs, and the low emissions levels of potentially harmful constituents, make the tobacco wax compositions of the present invention as highly desirable consumer products, particularly for the heat not burn tobacco category. Well most embodiments of the present invention contemplate that tobacco wax compositions will be consumed alone, it is also possible to use tobacco wax compositions in hybrid tobacco products. For example, the relatively low vapor production of reconstituted tobacco heat burn products may be improved by the addition of tobacco wax and/or tobacco wax compositions to the reconstituted sheet. The tobacco wax and/or tobacco wax compositions may be added to the matrix prior to casting or creating the reconstituted sheet, or added to after the reconstituted sheet is formed. Or, the tobacco wax composition may be positioned in a product separately from the reconstituted tobacco. For example, a cigarette form may comprise a tobacco wax composition, and separately, a plug of reconstituted tobacco. For such embodiments, it is particularly desirable to use a tobacco wax composition that is substantially a solid. The lower temperatures needed to vaporize tobacco wax compositions may be desirable here to produced effluent vapor while the reconstituted sheet is still in warm up phase. Similarly, tobacco wax compositions can be used with separately contained liquids, akin to British American Tobacco (Brands) Limited's iFUSE® product.

In certain embodiments, the pod is a cartridge that optionally comprises its own heating element.

Optionally, a cartridge may employ a filter to avoid any (or substantially any) droplets of the composition from inadvertent inhalation.

Stickiness of tobacco wax composition to the pod, cartridge or other vessel may be an issue. Stickiness is particularly an issue in a system (e.g. cartridge) where the heating element heats a small portion of the tobacco wax composition at a time (e.g. a JUUL® style cartridge or other cartridge design which heats a small portion of the tobacco wax composition to vaporization at a time).

In certain embodiments, the pod including without limitation a cartridge may use a low energy substrate for product contact areas. The substrate may be used for all product contact areas, substantially all, or part of product contact areas. Preferred substrates include FEP and PTFE. The substrate must be capable of handling the heat in the cartridge (or pod) without degradation, or with minimal degradation. Leaching is to be avoided.

In certain embodiments, the surface energy of the substrate used for product contact is less than 24 Dynes/cm, preferably less than 22 Dynes/cm, more preferably less than 20 Dynes/cm, and most preferably less than 19 Dynes/cm. Such low energy substrates may also be desirable for use in connection with product contact areas (or potential contact areas) of other heat not burn products, such as systems using a solid reconstituted tobacco matrix like IQOS, GLO or comparable systems, to reduce or eliminate undesirable sticking of the tobacco matrix.

In certain embodiments, heating of the tobacco wax composition is employed to reduce adhesion, including without limitation in certain embodiments in conjunction with a low surface energy substrate for product contact areas. Such heating preferably heats the tobacco wax composition being stored in the cartridge or other container (i.e. apart from the heating element). Preferably the tobacco wax composition is heated to 30° C. or above, preferably to 45° C. or above, more preferably to 55° C. or above. Such heating may occur via thermal conduction from the heating element in regular use. The cartridge may be designed to encourage such thermal conduction, including inter alia through the use of a cartridge (or pod) material with suitable thermal conduction properties. A non-limitative example is an aluminum cartridge with a low energy substrate coating the product contact areas. Other metals, and other thermal conductive materials may be used for this purpose.

Additionally, a secondary cartridge (or pod) heating element may be employed to reach desired temperatures for the tobacco wax composition in the chamber. The secondary heating element may be a filament, foil or other form that runs through the cartridge since the primary purpose of the secondary heating element is to warm the tobacco wax composition, as opposed to the primary heating element (which is intended to vaporize the composition). The secondary heating element may comprise a foil, a filament, or other known form. The secondary heating element may turn on when the primary heating element is used, or may have a heating separate logic (e.g. a warming cycle). The separate logic can include a warming cycle associated with an initial puff, and then repeated after a series of puffs, repeated after a time period (e.g. sixty seconds, ninety seconds, one hundred eight seconds, three minutes, or five minutes), or repeated based on a multiple factors (e.g. puffs and time, or other factors like ambient temperature, temperature of the primary heating element, or temperature within the cartridge). The logic of the warming cycle will be intended to be functional, to encourage flow of the tobacco wax composition towards the heating element, without unduly and unnecessarily draining battery power.

The secondary heating element preferably the tobacco wax composition in the cartridge (or pod) to above 35 C, preferably above 45° C., and most preferably above 55° C. A preferred range is 45 to 55° C. The intention is to increase flowability, without excessive heating which is associated with unneeded power use and potentially flashes off volatile constituents prior to desired consumption.

Generally, it is desirable for the secondary heating element to be in contact with a substantial portion of the tobacco wax composition in the cartridge. The secondary heating element may be shaped as half-circular loop, may be rectangular, or contain "turns" or angles that tend to increase overall length of the heating element and thus increase contact surface area of the secondary heating element. In certain embodiments, the secondary heating element divides into two symmetrical or semi-symmetrical loops on either side of the air tube from the primary heating element, allowing the secondary heating element to loop around or clear, a central airtube.

Desirably, the secondary heating element is longer than one cm, preferably longer than 1.5 cm, most preferably longer than 2 cm.

Desirably, the secondary heating element is wider, at its widest point than 0.025 cm, preferably wider than 0.05 cm, more preferably wider than 0.1 cm, and even more preferably wider than 0.15 cm. Width will, inter alia, increase the contact surface area of the secondary heating element.

In certain embodiments, the surface area of the secondary heating element is from 0.05 sq. cm to 0.6 sq. cm.

Thermal conductivity (often denoted k, λ, or x) is the property of a material to conduct heat. It is evaluated primarily in terms of the Fourier's Law for heat conduction. In general, thermal conductivity is a tensor property, expressing the anisotropy of the property.

Heat transfer occurs at a lower rate in materials of low thermal conductivity than in materials of high thermal conductivity. Correspondingly, materials of high thermal conductivity are widely used in heat sink applications and materials of low thermal conductivity are used as thermal insulation. The thermal conductivity of a material may depend on temperature. The reciprocal of thermal conductivity is called thermal resistivity.

The Wikipedia entry for thermal conductivity, is hereby incorporated by reference as if fully set forth herein, as retrieved on the date of filing of this application: en.wikipedia.org/wiki/Thermal_conductivity.

Thermal conductivity can be used to warm the portion of the tobacco wax composition that is not being vaporized, to promote flow. Thermally conductive materials may be used in whole, in part, or substantially to comprise the airtube. Thermally conductive materials may be used in whole, in part, or substantially, to comprise the cartridge or pod, including surfaces in contact with the tobacco wax composition or other contained material. Fibers, filaments, or a lattice of thermally conductive materials may be part of the cartridge. One advantage of such approach is to warm the tobacco wax composition without additional energy needs.

Selected materials may have a thermal conductivity value—a k value (W/m K) of greater than 35, preferably greater than 70, more preferably greater than 110, most preferably greater than 150.

In certain embodiments, materials may be used to insurance the mouthpiece does not become too hot. For example, an airtube may be made partially from a highly thermo conductive material, with a less thermo conductive material near the top of the mouthpiece.

A warming cycle may be used with the product is not in use to encourage flow of the tobacco wax composition towards to the heating element. Such a warming cycle may be used in one non-limitative embodiment, an external vaporizer charger unit holds the vaporizer in a vertical (or near vertical) position, and performs one or warming cycles to encourage flow of the tobacco wax composition down and towards the primary product heating element (located at the bottom end of the chamber).

In another non-limitative embodiment, the charger device has a separate heating element (separate from the heating element(s) in the vaporizer itself) that uses a warming cycle or cycles to encourage flow of the tobacco wax composition, optionally during the charging cycle. The warming cycle may take from 1 second to five minutes, preferably 2-4 minutes. Optionally, vibration or wave energy may be employed to encourage flow.

Heating the tobacco wax composition to promote flow, together with a low energy substrate, can encourage flow and allows for high efficiency of tobacco wax composition utilization from a cartridge. By tobacco tax composition utilization, we mean the percentage of the tobacco wax composition that is successfully vaporized. As demonstrated in Example Q below, with standard plastics, the tobacco wax composition utilization was relatively low at approximately 66%. Using suitable materials, we teach a tobacco wax composition utilization rate of greater than 75%, preferably greater than 80%, more preferably greater than 90%, and most preferably greater than 95%.

Texture may also be employed in cartridge (or pod or other container) to encourage flow of the tobacco wax composition. The use of texture to facilitate flow is described as the "Lotus Effect." Lai's "Mimicking Nature: Physical basis and artificial synthesis of the Lotus Effect" (2003) (available at web.archive.org/web/20070930222543/http://home.wanadoo.nl/scslai/lotus.pdf) is hereby incorporated by reference as if fully set forth herein. Additionally, en.wikipedia.org/wiki/Lotus_effect, as retrieved on Mar. 7, 2018, is hereby incorporated by reference as if fully set forth herein. These textures may be incorporated into the pod, cartridge or other container.

Some consideration should be given to the special geometry of the cartridge in order to promote flow of the tobacco wax composition. In certain embodiments, a certain width is desirable to promote flow the material. In certain embodiments, it is desirable that the top corners of the cartridge are rounded to promote flow.

Specifically, an internal width—meaning, a width measured from the inside surface edge across to the opposite inside surface—in certain embodiments is greater than 0.75 cm, preferably greater than 0.85 cm, more preferably greater than 0.95 cm, and most preferably greater than 1.05 cm.

In certain embodiments, the secondary heater is adhered, or substantially adhered, or part of the inside wall of the cartridge. In certain embodiments, the secondary heater contact area itself has a low surface energy, as discussed in this application, to promote flow.

Various aspects of the present invention can be used with compositions other than tobacco wax, including inter alia any botanical wax or botanical oil.

Certain embodiments of the invention are described herein with reference to FIGS. 1-13, which schematically show examples of the method and system of the present invention. However, applicants' invention is not limited to the particular embodiments/examples shown in the figures.

FIG. 1 is a perspective view showing a 11 heating chamber containing a 10 tobacco wax composition. The outside of the heating chamber assembly is 12. In certain preferred embodiments, the tobacco wax composition is in a pod.

Figure 2:
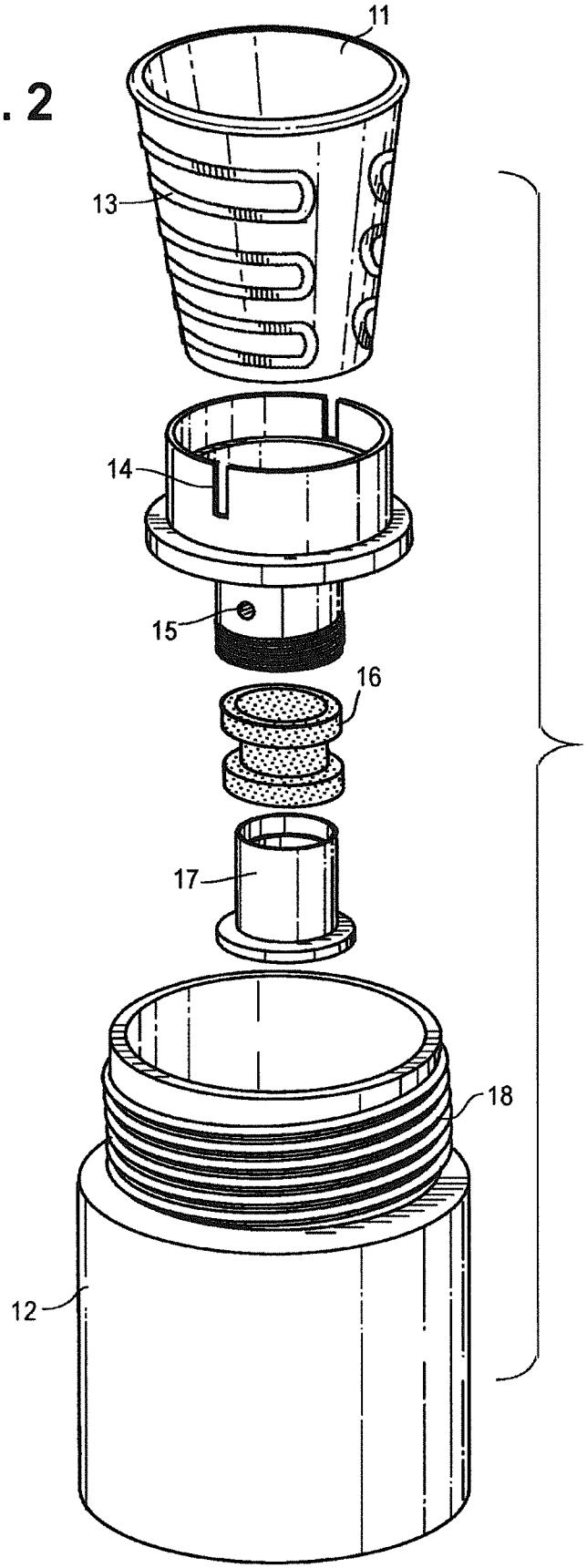
FIG. 2 is an exploded perspective of the hearing chamber sub assembly, including a ceramic heating chamber.

FIG. 2 is an exploded perspective of the heating chamber sub assembly, including a ceramic heating chamber 11, which may contain a pod or may comprise itself a pod. The 13 heating element may be printed or coated onto the heating chamber, which in preferred embodiments in ceramic. 12 is the wall of the heating chamber casing. 14 is an air flow slot for the heating chamber or pod receiver. 15 is an airhole in the heat chamber or pod receiver (other airhole figurations may be employed in different embodiments). 16 is an electrode insulator. 17 is the electrode. 18 is the mouthpiece screw thread.

Figure 3:
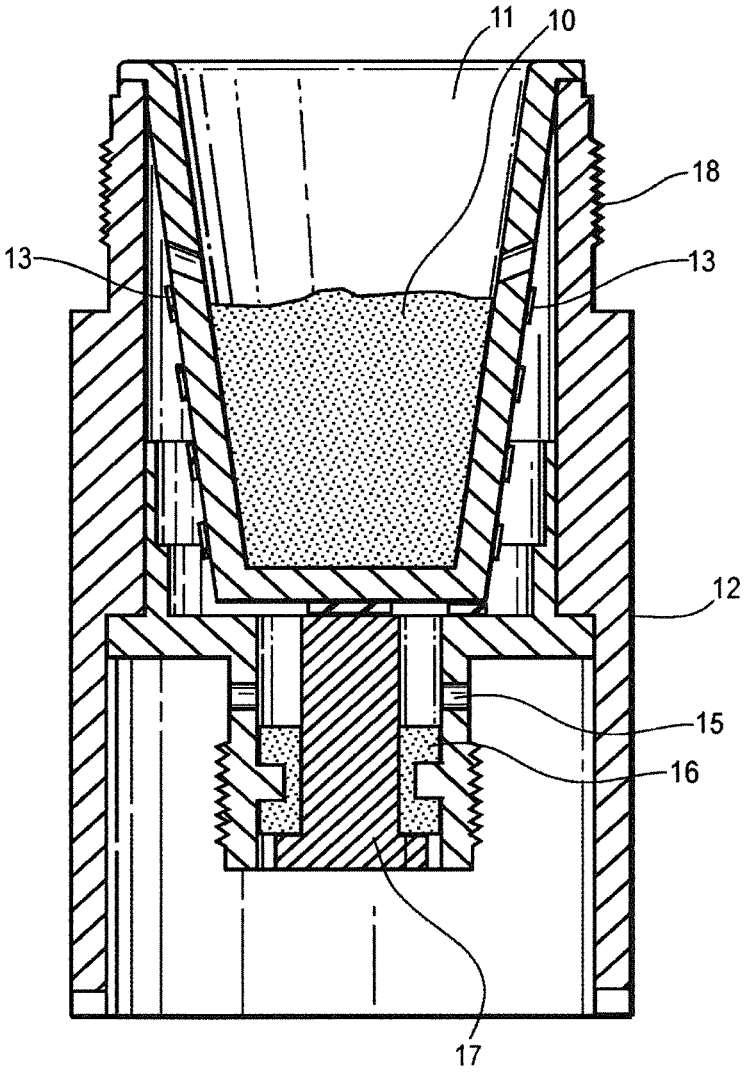
FIG. 3 is a cross-sectional view of the heating chamber containing a tobacco wax composition.

FIG. 3 is a cross-sectional view of the heating chamber containing a tobacco wax composition. 10 is the tobacco wax composition; other numbers are as above.

Figure 4:
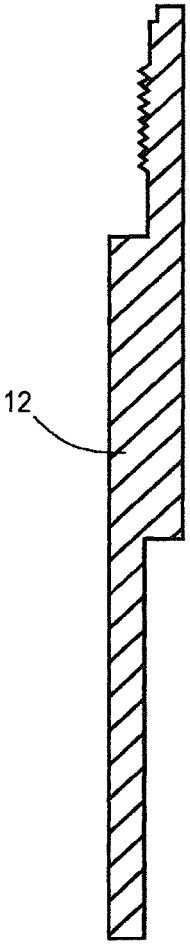
FIG. 4 is a cross section of the wall of the heating chamber casing.

FIG. 4 is a cross section of the wall of the 12 heating chamber casing.

Figure 5:
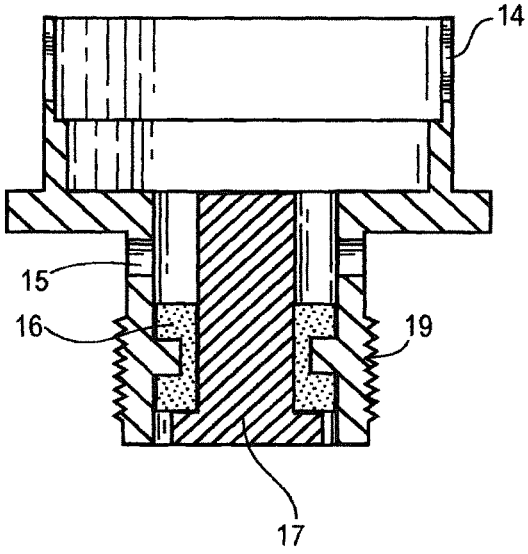
FIG. 5 is a cross section of the receiver for the heating chamber, including the battery connection section.

FIG. 5 is a cross section of the receiver for the heating chamber or pod, including the battery connection section. 19 is the battery screw thread.

Figure 6:
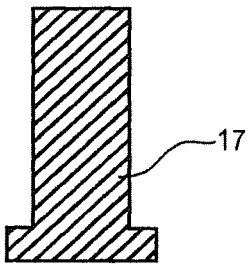
FIG. 6 is a cross section of the electrode.

FIG. 6 is a cross section of the 17 electrode.

Figure 7:
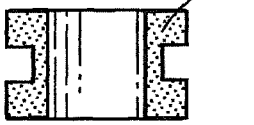
FIG. 7 is a cross section of the electrode insulator.

FIG. 7 is a cross section of the 16 electrode insulator.

Figure 8:
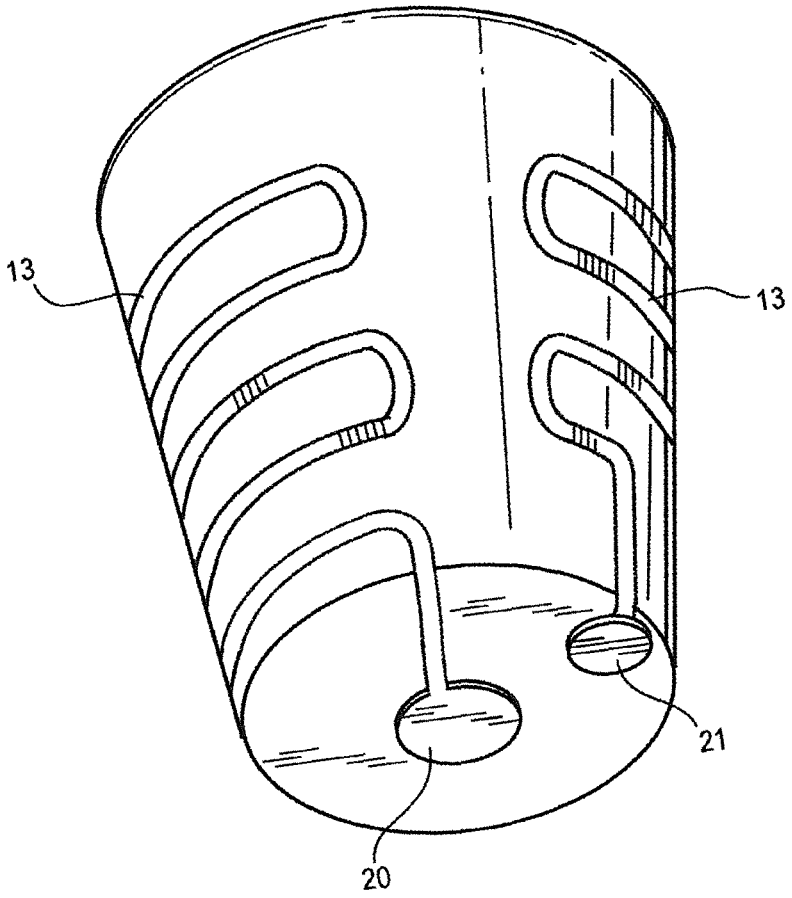
FIG. 8 is a perspective view of a ceramic pod showing a printed or coated heating element and positive and negative electrical contacts.

FIG. 8 is a perspective view of a pod (or heating chamber) showing a 13 printed or coated heating element and 20 positive and 21 negative electrical contacts.

Figure 9:
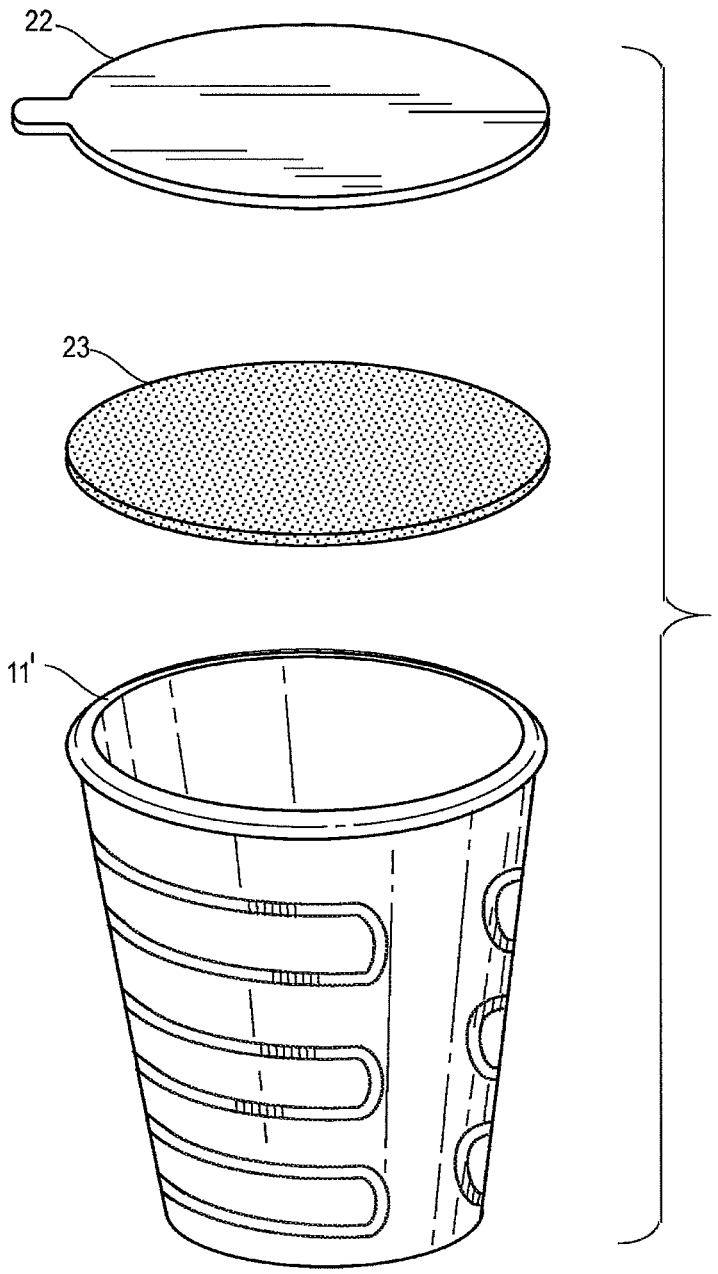
FIG. 9 is an exploded perspective view of a pod, a porous layer, and a barrier layer.

FIG. 9 is an exploded perspective view of a 11' pod, a 23 porous layer, and a 22 barrier layer.

Figure 10:
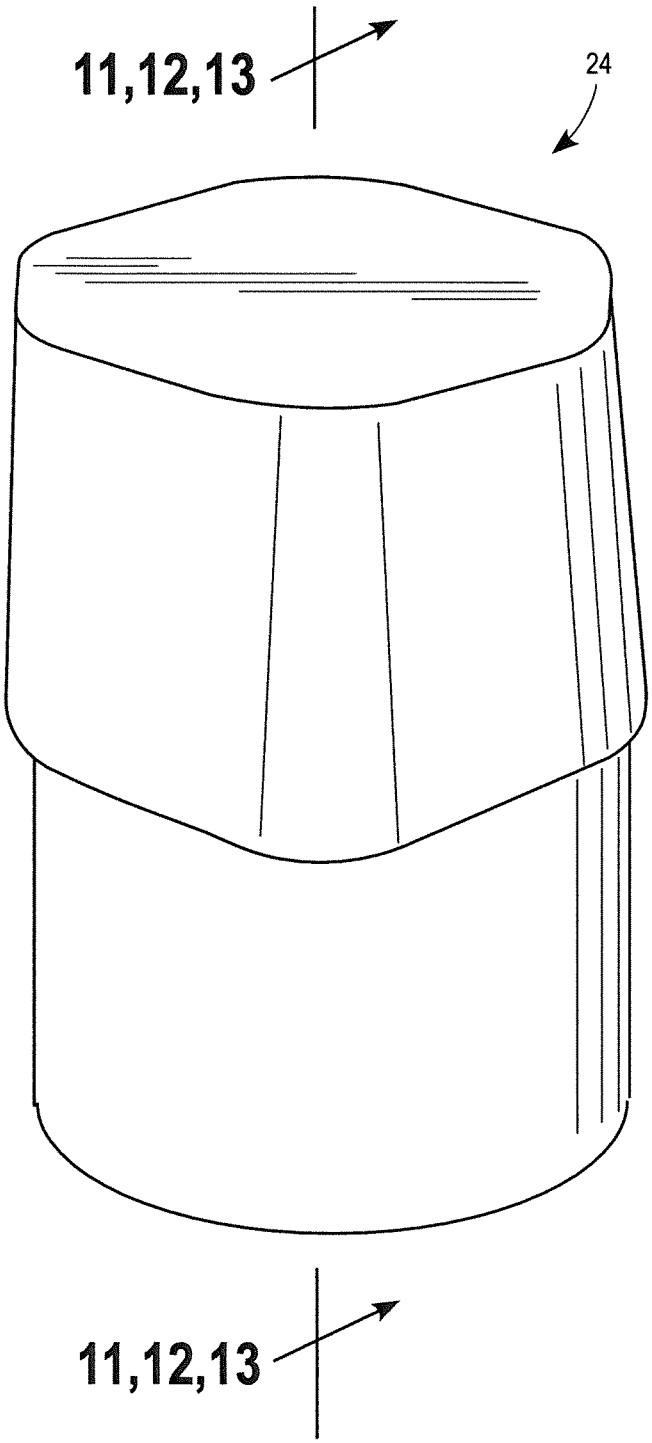
FIG. 10 is a perspective view of a cartridge.

FIG. 10 is a perspective view of a cartridge. 24 is the top of the cartridge.

Figure 11:
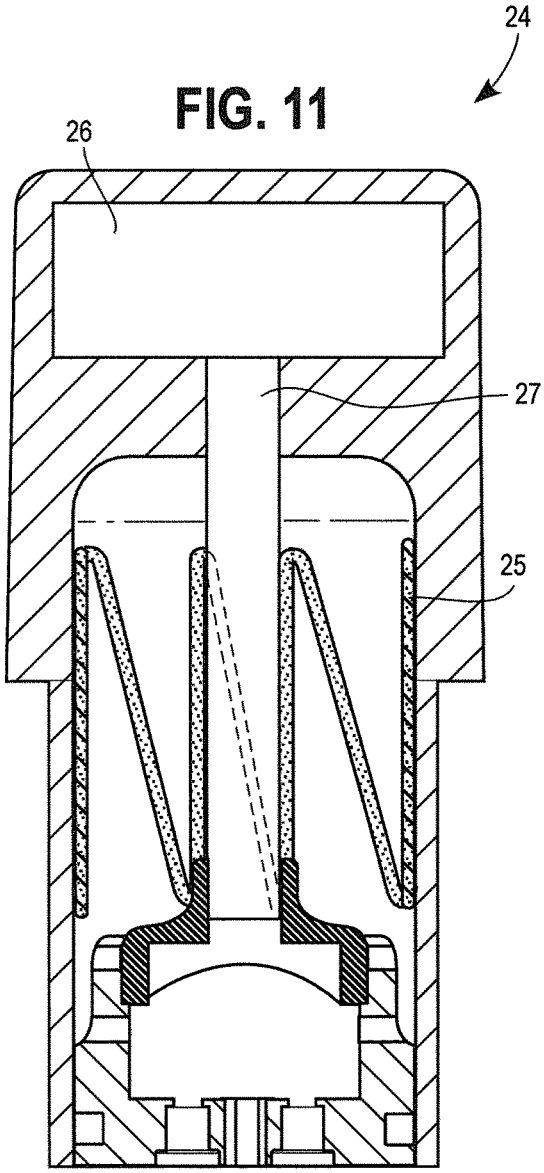
FIG. 11 is a cross section of a cartridge, showing a secondary heater that is adhered to the internal surface of the cartridge.

FIG. 11 is a cross section of a cartridge, showing a secondary heater that is adhered to the internal surface of the cartridge. 26 is an area that may contain a filter to prevent droplets from transiting to the user. 27 is the airtube. 25 is the secondary heater that is flush with the internal sides of the cartridge.

Figure 12:
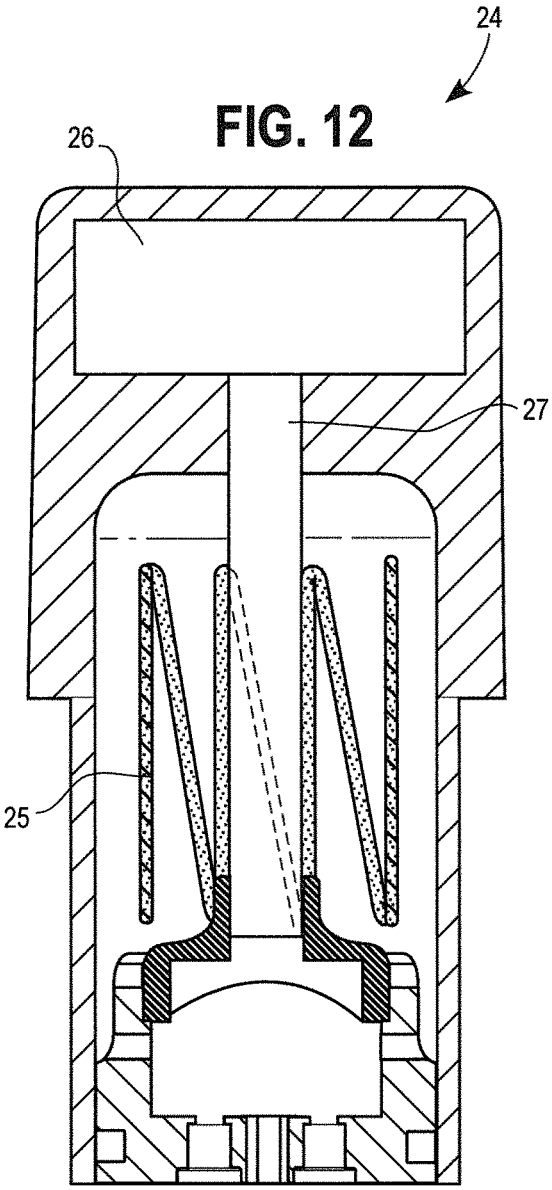
FIG. 12 is a cross section of a cartridge, showing a secondary heater that extends into the cartridge's reservoir.

FIG. 12 is a cross section of a cartridge, showing a secondary heater that extends into the cartridge's reservoir. 25 is a secondary heater with "turns" that is spread through the cartridge reservoir.

Figure 13:
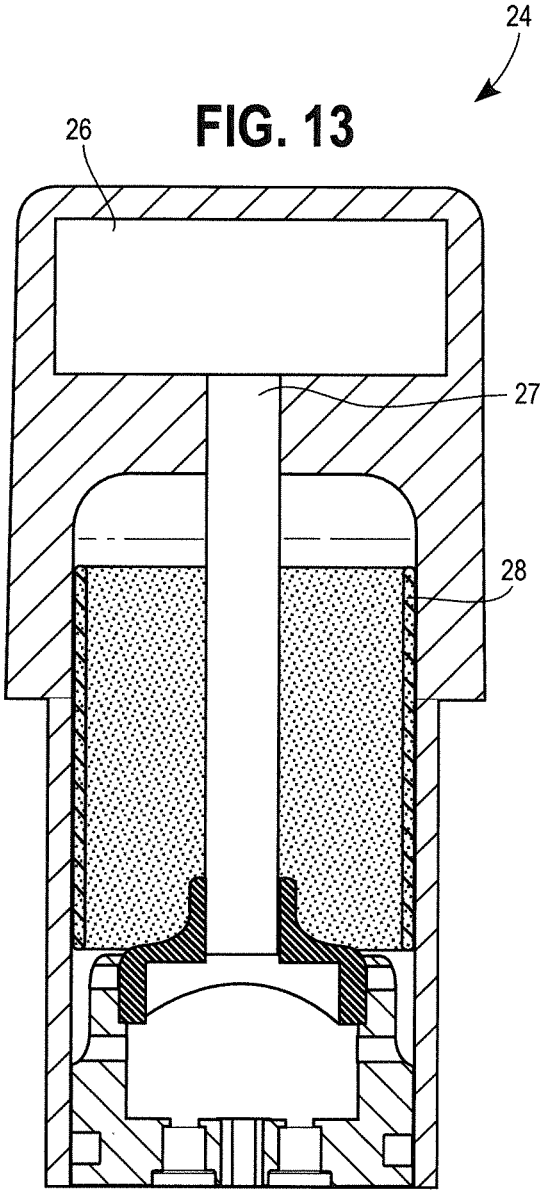
FIG. 13 is a cross section of a cartridge with a thermally conductive material on the walls of the cartridge that conducts heat from the primary, vaporizing heating element.

FIG. 13 is a cross section of a cartridge. 28 is a thermally conductive material on the walls of the cartridge that conducts heat from the primary, vaporizing heating element.

As is apparent, the tobacco wax composition is contained and bounded by the pod shape, or otherwise by the heating chamber. When used in a device, it typically comprises no substrate, paper or tipping paper. This absence distinguishes the product from typical heat not burn products like IQOS® or GLO®.

Example A

Tobacco wax was removed from tobacco leaf using supercritical CO2 extraction. Tobacco oil was mixed in with the wax, while retaining a wax consistency. The material was fragrant and dark brown in color. A nicotine assay indicated a nicotine strength for the tobacco wax of 4%. The wax was placed in a dry herb vaporizer and vaped by a healthy adult male. The tobacco wax vaporized creating a nice vapor volume. The nicotine delivery was strong and the product was fragrant with tobacco fragrance. The tobacco wax substantially vaporized leaving minimal residue on the heating coil.

Example B

The tobacco wax of Example A was taken and 10% of vegetable glycerin and 5% of propylene glycol (measuring by weight of the final composition) was added. The tobacco wax accepted the addition of these vapor agents. The resulting composition was placed in a dry herb vaporizer and used by a healthy adult male. The flavor was excellent and the vapor production was increased from Example A.

Example C

The tobacco wax of Example A was taken and grape flavor from Tobacco Technology Inc., Maryland was added, at 3.5% of the composition. The resulting tobacco wax composition was placed in a dry herb vaporizer and used by a healthy adult male. The grape taste was enjoyed by the user.

Example D

Tobacco wax was extracted from a different of blend tobacco leaf using supercritical CO2 extraction. The tobacco wax was dark with a slightly green tinge. The nicotine content of the tobacco wax was approximately 1.5%. Nicotine glycerin solution ($10^{\%}$) was added to 10% of the final composition weight. The product vaped well but the flavor notes where not as attractive as the tobacco wax of Example A. It was observed that additional flavors could improve the product.

Example E

Oil from the extraction of tobacco described in Example D was added to the tobacco wax of Example D, and the composition was mixed using strong shear forces. The resulting product vaped well and left very little residue.

Example F

Tobacco wax from Example A was placed in a vaporizer. A small amount of zero nicotine flavored e-liquid was added to the vaporizer. The two were not otherwise mixed other than to insert them together. The wax and the zero were vaporized together. A fair amount of residue was left by this mix in the vaporizer. The exercise was repeated with a yet smaller amount of e-liquid with improve results including much less residue.

Example G

Tobacco wax from Example A was compounded with a small amount of sodium carbonate as a buffer agent to affect a more basic pH.

Example H

Tobacco wax was extracted from flue cured tobacco with low TSNA levels. The extraction was performed using supercritical C02 extraction. The wax partition was approximately 4% of the mass of the starting tobacco. Tobacco wax was also extracted from burley tobacco with low TSNA levels, again using supercritical C02 extraction, and again with a yield of approximately 4%.

Example I

The tobacco wax partitions of Example H were blended, at a ratio of 70/flue cured to 30% burley. The combined wax partition was then mixed with vegetable glycerin, for a final composition of 50% tobacco wax, and 50% vegetable glycerin.

Example J

The final composition of example I was sent to a third party laboratory for nicotine testing. The composition was measured to contain 3.3% nicotine, implying that the blended wax partition had a starting nicotine level of 6.6% (prior to dilution with vegetable glycerin). LOQ for the testing was 0.16%.

Example K

The final composition of Example I was sent to a third party laboratory for emissions testing. Results were as follows.

| Puff Intervals | Propylene Glycol mg/puff | Ethylene Glycol mg/puff | Menthol mg/puff | Nicotine mg/puff | Diethylene Glycol mg/puff | Glycerol mg/puff | Aerosol Mass Collected mg | Device Loss Mass mg |
|---|---|---|---|---|---|---|---|---|
| 1-50 | BQL | BQL | BQL | 0.051 | BQL | 0.510 | 34.9 | 52.2 |
| LOQ | 0.020 | 0.002 | 0.004 | 0.008 | 0.002 | 0.020 | NA | NA |

Carbonyls testing results were as follows.

| Puff Intervals | Acetaldehyde µg/puff | Acetoin µg/puff | Acetyl Propionyl µg/puff | Crontonaldehyde µg/puff | Diacetyl µg/puff | Formaldehyde µg/puff | Device Loss Mass mg |
|---|---|---|---|---|---|---|---|
| 1-50 | 0.06 | BQL | BQL | BQL | BQL | BQL | 31.1 |
| LOQ | 0.02 | 0.02 | 0.02 | 0.02 | 0.02 | 0.02 | NA |

TNSA results were as follows.

| Puff Interval | NNN ng/puff | NNK ng/puff | Aerosol Mass Collected mg | Device Loss Mass mg |
|---|---|---|---|---|
| 1-50 | BQL | BQL | 45.0 | 51.6 |
| LOQ | 0.20 | 0.20 | NA | NA |
| | | NAT ng/g | | NAB ng/g |
| | FC/BU Blend | BQL | | BQL |
| | LOQ | 15 | | 15 |

The smoke regime for the above testing was: 55 mL puff/30 sec interval/3 sec duration. The composition was vaporized in a vaporization pen, on high heat.

Inventors compared the above results with those publicly available for Philip Morris International's IQOS® system (see papers linked from www.pmiscience.com, including inter alia, Zenzen et al. "Reduced exposure evaluation of an Electrically Heated Cigarette Smoking System. Part 2: Smoke chemistry and in vitro toxicological evaluation using smoking regimens reflecting human puffing behavior" *Regulatory Toxicology and Pharmacology*, Volume 71, Issue 2, March 2015). The inventors concluded that the tobacco wax composition of the present invention provides superior toxicant profile (i.e. substantially lower levels of the measured toxicants) as compared with IQOS®. This was particularly notable in the case of formaldehyde, which is considered to be a lower temperature degradant product, and hence one that is difficult to substantially reduce in heat not burn tobacco products (as compared with combustibles). For an excellent discussion of combustion and tobacco, see Thomas McGrath's presentation entitled "What is combustion and why is the absence of combustion important for heat not burn products" (Jun. 16, 2017 presentation at the Global Forum on Nicotine 2017) (available here: gfn.net.co/downloads/Presentations_2017_/Dr %20Thomas %20Mc %20Grath.pdf). All of the above references are hereby incorporated by reference as if fully stated herein.

Whereas McGrath describes reduced toxicant formation (as compared with combustibles) of >90 to >95% (and such results with a less rigorous 2 second puff testing, 55 ml, 30 second intervals), Applicants achieved superior reductions with the above results, i.e. >98% reduction and in many cases below quantifiable limits. Applicants noted that achieving superior toxicant reductions is particularly surprising in view of the multi-billion dollar R&D effort (publicly disclosed) associated with the development of IQOS.

Applicants postulated that the basis for this surprising result may reflect in part reduced energy requirements to volatilize the tobacco wax compositions of the present invention, as compared to the energy requirements needed aerosolized the components contained in the solid matrix which is the reconstituted tobacco comprising the HEATSTICKS® used in IQOS®.

Applicants noted that below quantifiable limits indicates that no amount of the analyte exists above the limit of quantification. Thus, in the case of each analyte measuring below quantifiable limits, the analyte is understood to exist at a level ranging from zero to less than the quantifiable limit.

Example L

Polysorbate (Tween 20) was added to the composition of Example I, and the resulting composition was placed in 5 mL tubes, alongside of 5 ml tubes filled with the composition of I. It was noted that the addition of polysborbate substantially reduced separation of the vegetable glycerin from the tobacco wax.

Example M

A healthy male volunteer vaped the tobacco extracts described in Example II separately, i.e. as flue cured and burley (each with glycerin), and a 70-30 blend (each with glycerin). The blend was particularly pleasant, offered excellent tobacco flavor and rich tobacco satisfaction.

Example N

A healthy male volunteer took a PLOOM® Model 2 device, and removed the tobacco from the product's pod, and replaced this tobacco with the tobacco wax composition of L. The Model 2 was then started in accordance with its directions. The Model 2 has a thirty second warm up period, and reaches an operating temperature of 175° C./347° F. The tobacco wax composition violently vaporized during the warm up phase (the indicating light blinks during said phase), and bubbled out of the mouthpiece. This demonstrated that the tobacco wax composition, in certain embodiments of the present invention, readily vaporizes under 347° F. The inventors attributed the ability of the tobacco wax vaporization to be readily vaporized—using on-off heating (as opposed to a prolonged warm up stage—meaning a warm up stage taking over 3, 4 or 5 seconds).

Example O

This example relates to vaporization temperature testing.

The sample tested was made as follows. The wax and oil partitions from supercritical fluid (C02) extraction of Flue Cured tobacco were combined. The wax and oil partitions from supercritical fluid (C02) extraction of Burley Tobacco were combined. The result was a very viscous, if flowable liquid. These two were mixed in a ratio of 70:30 (seven parts flue cured to three parts burley). This mixture was in turn combined with vegetable glycerin in a ratio of 50:50 (one part of tobacco mixture to one part of vegetable glycerin).

A simple closed pod system was filled with the tobacco wax composition. Testing equipment included a Digital Multimeter (RIGOL® DM 3068), a temperature sensor (PT100A), a brass steamer, and MATLAB® software.

With approximate 5 watt power, some burning was observed. With power reduced to 3.5 watt, the system product very thick vapor without burning. The system was able to produce good vapor at 1.7 watt. The power for a tobacco wax composition vaporizer is preferably 1.25 to 4 watts, more preferably.

Some boiling was observed at 100 C, which suggests some residual water content. Vapor production began at 160 C. Thicker vapor began at 200 C. Temperature stabilized at 240 C, suggesting 240 C as the maximum vaporization temperature. This suggests a heating temperature range in which to operate of 160 C to 250 C, preferably 180 C to 230 C, more preferably 200 C to 220 C.

Notably, the viscosity of the tobacco wax composition reduced under heat. Reduction was observed starting at 30 C, with greater effect noted at 45 C.

Example P

Example P involved a series of tests using the tobacco wax composition of Example O. This tobacco wax composition was placed in a plastic cartridge similar to the JUUL system sourced from American Wholesale Vapor, Shenzhen China. The cartridge was able to vaporize the composition very effectively, with "on off" functionality—meaning there was no discemable time lab from the time the device was activated from inhalation (suction) and the production of vapor. However, sticking of the tobacco wax composition was observed, which resulted on amounts of the tobacco wax composition sticking to the cartridge and failing to vaporize.

Different substrates were considered that could reduce or eliminate sticking in a cartridge.

Surface energy of substrates was considered with reference to Technibond Limited UK literature (2018) (technibond.co.uk).

Substrate Surface Energy (Dynes/cm)

| | |
|---|---|
| Copper | 1103 |
| Aluminum | 840 |
| Tin | 526 |
| Stainless Steel | 700-1100 |
| Glass | 250-500 |
| KAPTON ® (Polyimide) | 50 |
| Polycarbonate | 42 |
| PVC (Polyvinyl Chloride) | 39 |
| Polyethylene | 31 |
| Polypropylene | 29 |
| Silicones | 22-24 |
| TEFLON ® PTFE | 18 |

The tobacco wax composition is strongly adherent to each surface at room temperature regardless of surface energy. At room temperature, adhesion is strong, even on TEFLON®. DELRIN®, a polyoxymethylene polymer, also showed adhesion at room temperature.

| Property | PTFE | FEP | PFA | ETFE |
|---|---|---|---|---|
| Non-Stick | Excellent | Excellent | Excellent | Fair |
| Heat Resist | 260 C.+ | 200 C. | 260 C. | 150 C. |
| Hardness | 60D | 55D | 60D+ | 75D |
| Salt Spray | Fair | Excellent | Excellent | Excellent |
| Abrasion Resistance | Fair | Good | Very Good | Excellent |

The above chart is reproduced from the following website: www.product-release.com/our-labs/.

PTFE is polytetrafluoroethylene. FEP is fluorinated ethylene propylene. PFA is perfluoroalkoxy copolymer. ETFE is (ethylene-tetrafluoroethylene).

A thin film of CHEMOURS® FEP was tried and even at room temperature there was a slight beading of the tobacco wax composition. At increasing temperature for the tobacco wax composition, the PTFE and FEP low surface energy polymers begin to show non-stick behavior with the tobacco wax composition. Visually, FEP appears superior to PTFE.

Solid plates of FEP and PTFE were purchased and heated on a heating block with noticeable change in tobacco wax composition adhesion. From visual assessments, 45° C. appeared to be a minimum sweet spot for FEO and the tobacco wax composition (to reduce adhesion).

At higher temperatures (above 45° C.), the effect is more pronounces with the tobacco wax composition not sticking to the substrate. It also appears to be reversible for both polymers when the temperature is cycled between room temperature and 45 C. There is a pronounced change in the contact angle.

XYLAN® PLUS (fluoropolymer based) aluminum coatings—even at higher temperatures—did not result in reduced adhesion. The same observation was made for a ceramic coating. However, it was noted that the TEFLON® suite of products may be useful.

A low surface energy substrate may be used to in a cartridge (or pod or other container) to reduce adhesion of the tobacco wax composition. The lower energy substrate is less than 24 Dynes/cm, preferably less than 22 Dynes/cm, more preferably less than 20 Dynes/cm, and most preferably less than 19 Dynes/cm. In certain embodiments, heating of the tobacco wax composition is employed to reduce adhesion. Such heating preferably heats the tobacco wax composition being stored in the chamber (i.e. apart from the heating element). Preferably the tobacco wax composition is heated to 30 C or above, preferably to 45 C or above, more preferably to 55 C or above. Heating the tobacco wax composition to promote flow, together with a low energy substrate, can encourage flow and allows for high efficiency of tobacco wax composition utilization from a cartridge. By tobacco tax composition utilization, we mean the percentage of the tobacco wax composition that is successfully vaporized. As demonstrated in Example Q below, with standard plastics, the tobacco wax composition utilization was relatively low. Using suitable materials, we teach a tobacco wax composition utilization rate of greater than 75%, preferably greater than 80%, more preferably greater than 90° %, and most preferably greater than 95%.

Texture may also be employed in cartridge (or pod or other container) to encourage flow of the tobacco wax composition. The use of texture is described as the "Lotus Effect."

Example Q

This example demonstrates tobacco wax composition utilization using a standard cartridge, similar to JUUL system sourced from American Wholesale Vapor, Shenzhen China. The cartridge was filled with the tobacco wax composition of Example P. Using a standard balance, the amount of tobacco wax composition added to the cartridge was measured at 900 milligrams. A healthy adult volunteer used the cartridge over a period of three days, to the point at which the cartridge would no longer produce substantial vapor. The cartridge was weighed again to determine the residual tobacco wax composition that failed to vaporize, and that amount was calculated to be approximately 300 grams, implying a tobacco wax composition utilization rate of 66%. This utilization rate can be improved upon using superior materials and methods, as taught herein.

Example R

This example demonstrated in inability to combust or light the tobacco wax composition of Example O. The tobacco wax composition was placed in an aluminum foil substrate, and it was attempted to be lit using a long-necked butane lighter (commonly used for bbq use). Despite holding the flame in contact with the tobacco wax composition for periods of up to thirty seconds, no propensity for combustion was observed. The tobacco wax composition could but be ignited or lit with a butane lighter ("non-combustible"). In contrast, using the same lighter attempts were made to light a KENT® NEOSTICK™ for GLO. The NEOSTICK™ lit fairly easily and was able to be smoked like a cigarette. This NEOSTICK™ experiment was repeated after a NEOSTICK™ had been used, and again the NEOSTICK™ lit readily and was able to be smoked.

Example S

As noted above, Coresta Guide N 1 (the Concept and implementation of CPA Guidance Residue Levels) (July 2016 with additional CPA June 2018) is hereby incorporated by reference as if fully stated herein. It is desirable that the level of each or any specific CPA listed below is less than 200/of the GRL standard, preferably less than 150% of the GRL standard, more preferably less than 100% of the GRL standard, yet more preferably less than 75% of the GRL standard, and most preferably less than 75% of the GRL standard (in each case such standard as set forth below).

| No. | CPA | GRL (ppm) | Residue definition | Notes |
|---|---|---|---|---|
| 1 | 2,4,5-T | 0.05 | 2,4,5-T | |
| 2 | 2,4-D | 0.2 | 2,4-D | |
| 3 | Acephate | 0.1 | Acephate | |
| 4 | Acetamiprid | 3 | Acetamiprid | |
| 5 | Acibenzolar-S-methyl | 5 | Acibenzolar-S-methyl | |
| 6 | Alachlor | 0.1 | Alachlor | |
| 7 | Aldicarb (□) | 0.5 | sum of Aldicarb, Aldicarb sulfoxide and Aldicarb sulfone, expressed as Aldicarb | |
| 8 | Aldrin + Dieldrin | 0.02 | Aldrin + Dieldrin | |
| 9 | Azinphos-ethyl | 0.1 | Azinphos-ethyl | |
| 10 | Azinphos-methyl | 0.3 | Azinphos-methyl | |
| 11 | Benalaxyl | 2 | Benalaxyl | |
| 12 | Benfluralin | 0.06 | Benfluralin | |
| 13 | Benomyl[(a)] | | sum of Benomyl, Carbendazim, and Thiophanate-methyl expressed as Carbendazim | see Carbendazim |
| 14 | Bifenthrin | 3 | Bifenthrin | |
| 15 | Bromophos | 0.04 | Bromophos | |
| 16 | Butralin | 5 | Butralin | |

-continued

| No. | CPA | GRL (ppm) | Residue definition | Notes |
|---|---|---|---|---|
| 17 | Camphechlor (□) (Toxaphene) | 0.3 | Camphechlor (mixture of chlorinated camphenes) | |
| 18 | Captan | 0.7 | Captan | |
| 19 | Carbaryl | 0.5 | Carbaryl | |
| 20 | Carbendazim[a] | 2 | sum of Benomyl, Carbendazim, and Thiophanate-methyl expressed as Carbendazim | |
| 21 | Carbofuran (□) | 0.5 | sum of Carbofuran and 3-Hydroxycarbofuran expressed as Carbofuran | |
| 22 | Chinomethionat | 0.1 | Chinomethionat | |
| 23 | Chlorantraniliprole | 10 | Chlorantraniliprole | |
| 24 | Chlordane (□) | 0.1 | sum of cis-Chlordane and trans-Chlordane | |
| 25 | Chlorfenvinphos (□) | 0.04 | sum of (E)-Chlorfenvinphos and (Z)-Chlorfenvinphos | |
| 26 | Chlorothalonil | 1 | Chlorothalonil | |
| 27 | Chlorpyrifos | 0.5 | Chlorpyrifos | |
| 28 | Chlorpyrifos-methyl | 0.2 | Chlorpyrifos-methyl | |
| 29 | Chlorthal-dimethyl | 0.5 | Chlorthal-dimethyl | |
| 30 | Clomazone | 0.2 | Clomazone | |
| 31 | Cyfluthrin (□) | 2 | Cyfluthrin (sum of all isomers) | |
| 32 | Cyhalothrin (□) | 0.5 | Cyhalothrin (sum of all isomers) | |
| 33 | Cymoxanil | 0.1 | Cymoxanil | |
| 34 | Cypermethrin (□) | 1 | Cypermethrin (sum of all isomers) | |
| 35 | DDT (□) | 0.2 | sum of o,p'- and p,p'-DDT, o,p'- and p,p'-DDD (TDE), o,p'- and p,p'-DDE expressed as DDT | |
| 36 | Deltamethrin[b] | 1 | sum of Deltamethrin and Tralomethrin expressed as Deltamethrin | |
| 37 | Demeton-S-methyl (□) | 0.1 | sum of Demeton-S-methyl, Oxydemeton-methyl (Demeton-S-methyl sulfoxide) and Demeton-S-methyl sulfone expressed as Demeton-S-methyl | |
| 38 | Diazinon | 0.1 | Diazinon | |
| 39 | Dicamba | 0.2 | Dicamba | |
| 40 | Dichlorvos[c] | 0.1 | sum of Dichlorvos, Naled and Trichlorfon expressed as Dichlorvos | |
| 41 | Dicloran | 0.1 | Dicloran | |
| 42 | Diflubenzuron | 0.1 | Diflubenzuron | |
| 43 | Dimethoate[d] | 0.5 | sum of Dimethoate and Omethoate expressed as Dimethoate | |
| 44 | Dimethomorph (□) | 2 | sum of (E)-Dimethomorph and (Z)-Dimethomorph | |
| 45 | Disulfoton (□) | 0.1 | sum of Disulfoton, Disulfoton sulfoxide, and Disulfoton sulfone expressed as Disulfoton | |
| 46 | Dithiocarbamates (as $CS_2$)[e] | 5 | Dithiocarbamates expressed as $CS_2$ | In countries where fungal diseases such as blue mould are a persistent problem in the field throughout the growing season, the use of dithiocarbamates (DTC) fungicides may be an essential part of the season-long disease management strategy and in keeping with GAP as a means of ensuring crop quality and economic viability for the producer. Under high disease pressure residues of dithiocarbamates (DTC) fungicides slightly in excess of the specified GRL may be observed. In countries where there is not a field fungal disease problem the use of fungicides is not necessary, and there should be no residues detected. Consistent with GAP, dithiocarbamates (DTC) fungicides must be used only according to label instructions to combat fungal diseases in the seedbed and in the field. |
| 47 | Endosulfans (□) | 1 | sum of alpha- and beta-isomers and Endosulfan-sulphate expressed as Endosulfan | |

-continued

| No. | CPA | GRL (ppm) | Residue definition | Notes |
|---|---|---|---|---|
| 48 | Endrin | 0.05 | Endrin | |
| 49 | Ethoprophos | 0.1 | Ethoprophos | |
| 50 | Famoxadone | 5 | Famoxadone | |
| 51 | Fenamiphos (□) | 0.5 | sum of Fenamiphos, Fenamiphos sulfoxide and Fenamiphos sulfone expressed as Fenamiphos | |
| 52 | Fenitrothion | 0.1 | Fenitrothion | |
| 53 | Fenthion (□) | 0.1 | sum of Fenthion, Fenthion sulfoxide and Fenthion sulfone expressed as Fenthion | |
| 54 | Fenvalerate (□) | 1 | Fenvalerate (sum of all isomers including Esfenvalerate) | |
| 55 | Fluazifop-butyl (□) | 1 | Fluazifop-butyl (sum of all isomers) | |
| 56 | Flumetralin | 5 | Flumetralin | |
| 57 | Fluopyram[g] | 5 | Fluopyram | |
| 58 | Folpet | 0.2 | Folpet | |
| 59 | HCH (□-, □-, □-) | 0.05 | HCH (□-, □-, □-) | |
| 60 | HCH (□-) (Lindane) | 0.05 | HCH (□-) (Lindane) | |
| 61 | Heptachlor □□□ | 0.02 | sum of Heptachlor and two Heptachlor epoxides (cis- and trans-) expressed as Heptachlor | |
| 62 | Hexachlorobenzene | 0.02 | Hexachlorobenzene | |
| 63 | Imidacloprid | 5 | Imidacloprid | |
| 64 | Indoxacarb (□) | 15 | Sum of S isomer + R isomer | |
| 65 | Iprodione (□) | 0.5 | sum of Iprodione and N-3,5-dichlorophenyl-3-isopropyl-2,4-dioxoimidazolyzin-1-carboxamide expressed as Iprodione | |
| 66 | Malathion | 0.5 | Malathion | |
| 67 | Maleic hydrazide | 80 | Maleic hydrazide (free and bounded form) | In some instances, where GAP is implemented and label recommendations with regard to application rates and timing are strictly adhered to, residue levels may exceed the current GRL of 80 ppm as a result of extreme weather conditions and the current technology available for application. However, as with all CPAs, all efforts should be made to strictly follow label application rates, and use should be no more than necessary to achieve the desired effect. |
| 68 | Metalaxyl (□) | 2 | sum of all isomers including Metalaxyl-M/Mefenoxam | |
| 69 | Methamidophos | 1 | Methamidophos | |
| 70 | Methidathion | 0.1 | Methidathion | |
| 71 | Methiocarb (□) | 0.2 | sum of Methiocarb, Methiocarb sulfoxide, and Methiocarb sulfone expressed as Methiocarb | |
| 72 | Methomyl[f] | 1 | sum of Methomyl, Methomyl-oxim, and Thiodicarb expressed as Methomyl | |
| 73 | Methoxychlor | 0.05 | Methoxychlor | |
| 74 | Mevinphos (□) | 0.04 | Mevinphos (sum E and Z isomers) | |
| 75 | Mirex | 0.08 | Mirex | |
| 76 | Monocrotophos | 0.3 | Monocrotophos | |
| 77 | Naled[c] | | sum of Dichlorvos, Naled, and Trichlorfon expressed as Dichlorvos | see Dichlorvos |
| 78 | Nitrofen | 0.02 | Nitrofen | |
| 79 | Omethoate[d] | | sum of Dimethoate and Omethoate expressed as Dimethoate | see Dimethoate |
| 80 | Oxadixyl | 0.1 | Oxadixyl | |
| 81 | Oxamyl | 0.5 | Oxamyl | |
| 82 | Parathion (-ethyl) | 0.06 | Parathion | |
| 83 | Parathion-methyl | 0.1 | Parathion-methyl | |
| 84 | Pebulate | 0.5 | Pebulate | |
| 85 | Penconazole | 1 | Penconazole | |
| 86 | Pendimethalin | 5 | Pendimethalin | |
| 87 | Permethrin (□) | 0.5 | Permethrin (sum of all isomers) | |
| 88 | Phorate | 0.05 | Phorate | |
| 89 | Phosalone | 0.1 | Phosalone | |
| 90 | Phosphamidon (□) | 0.05 | Phosphamidon (sum of E and Z isomers) | |
| 91 | Phoxim | 0.5 | Phoxim | |
| 92 | Piperonyl butoxide | 3 | Piperonyl butoxide | |

-continued

| No. | CPA | GRL (ppm) | Residue definition | Notes |
|---|---|---|---|---|
| 93 | Pirimicarb | 0.5 | Pirimicarb | |
| 94 | Pirimiphos-methyl | 0.1 | Pirimiphos-methyl | |
| 95 | Profenofos | 0.1 | Profenofos | |
| 96 | Propoxur | 0.1 | Propoxur | |
| 97 | Pymetrozine | 1 | Pymetrozine | |
| 98 | Pyrethrins (□) | 0.5 | sum of Pyrethrins 1, Pyrethrins 2, Cinerins 1, Cinerins 2, Jasmolins 1 and Jasmolins 2 | |
| 99 | Tefluthrin | 0.1 | Tefluthrin | |
| 100 | Terbufos (□) | 0.05 | sum of Terbufos, Terbufos sulfoxide and Terbufos sulfone expressed as Terbufos | |
| 101 | Thiamethoxam | 5 | Thiamethoxam | |
| 102 | Thiodicarb[(j)] | | sum of Methomyl, Methomyl-oxim, and Thiodicarb expressed as Methomyl | see Methomyl |
| 103 | Thionazin | 0.04 | Thionazin | |
| 104 | Thiophanate-methyl[(a)] | | sum of Benomyl, Carbendazim, and Thiophanate-methyl expressed as Carbendazim | see Carbendazim |
| 105 | Tralomethrin[(b)] | | sum of Deltamethrin and Tralomethrin expressed as Deltamethrin | see Deltamethrin |
| 106 | Trichlorfon[(c)] | | sum of Dichlorvos, Naled, and Trichlorfon expressed as Dichlorvos | see Dichlorvos |
| 107 | Trifluralin | 0.1 | Trifluralin | |

Example T (Viscosity Measurement)

For this example viscosity is measured for the sample of Example O.

Sample is non-Newtonian, pseudoplastic (shear thinning) and thixotropic. It was noted that the condition of being thixotropic is desirable, in certain embodiments, for stability of the emulsion. It was also noted that the condition of being pseudoplastic, was similarly desirable for the stability of the emulsion and/or suspension.

| rpm | cps | Temp ° C. | |
|---|---|---|---|
| 2.5 | 14,800 | 25.4 | equilibrium values at each rpm |
| 5 | 8,640 | 25.3 | Brookfield RVII + |
| 10 | 4,480 | 25.4 | Spindle 4 |
| 2.5 | 11,280 | 40.4 | |
| 5 | 5,400 | 40.7 | |
| 10 | 2,280 | 40.7 | |

Example U

The sample of Flue Cured Tobacco wax extraction, mixed 50-50 with vegetable glycerin, and then adding a top flavor sourced from Hertz Flavors GmbH & Co. KG, equal to 2.5% of the final composition, was placed in a CHILL™ vaporizer, available from American Wholesale Vapor, with medium heat setting. Emissions were measured using the following smoke regime: 110 mL puff/30 sec interval/3 sec duration. The method used was LP-721 (Determination of Selected Carbonyls in E-Cigarette Related Samples).

Results were as follows.

| Puff Collected | Acetal-dehyde µg/puff | Acetoin µg/puff | Acetyl Propionyl µg/puff | Cronton-aldehyde µg/puff | Diacetyl µg/puff | Formaldehyde µg/puff | Device Loss Mass mg |
|---|---|---|---|---|---|---|---|
| 25 | 0.04 | BQL | BQL | BQL | BQL | 0.08 | 125 |
| LOQ | 0.04 | 0.04 | 0.04 | 0.04 | 0.04 | 0.04 | NA |

Additional results were as follows:

| Puffs Collected | Aerosol Mass Collected mg/puff | CO mg/puff | Water mg/puff | Nicotine mg/puff | NFDPM* mg/puff | Device Weight Loss Mass mg/puff |
|---|---|---|---|---|---|---|
| 25 | 3.05 | BQL | 0.53 | 0.141 | 2.38 | 3.40 |
| LOQ | NA | NA | 0.04 | 0.016 | NA | NA |

The method used was: LP-717: Determination of Nicotine, Menthol, Propylene Glycol, Glycerol, Water, and of Diethylene Glycol and Ethylene Glycol Impurities in E-Cigarette Formulations in Smoke/Vapor Samples.

Applicants noted the desirability of a tobacco wax product, when tested using the above methods, i.e. (110 mL puff/30 sec interval/3 sec duration), and measured using LP-721 method, that yielded a formaldehyde level of under 0.1 µg/puff, preferably less than 0.09 µg/puff.

Applicants noted the desirability of a tobacco wax product, when tested using the above methods, i.e. (110 mL puff/30 sec interval/3 sec duration), and measured using LP-721 method, that yielded a acetaldehyde level of under 0.1 µg/puff, preferably less than 0.09 µg/puff.

Applicants noted the desirability of a tobacco wax product, when tested using the above methods, i.e. (110 mL puff/30 sec interval/3 sec duration), and measured using LP-721 method, that yielded a acetoin level of BQL μg/puff, where LOQ is 0.04.

Applicants noted the desirability of a tobacco wax product, when tested using the above methods, i.e. (110 mL puff/30 sec interval/3 sec duration), and measured using LP-721 method, that yielded a Acetyl Propionyl level of BQL μg/puff, where LOQ is 0.04.

Applicants noted the desirability of a tobacco wax product, when tested using the above methods, i.e. (110 mL puff/30 sec interval/3 sec duration), and measured using LP-721 method, that yielded a Acetyl Propionyl level of BQL μg/puff, where LOQ is 0.04.

Applicants noted the desirability of a tobacco wax product, when tested using the above methods, i.e. (110 mL puff/30 sec interval/3 sec duration), and measured using LP-721 method, that yielded a Crotonaldehyde level of BQL μg/puff, where LOQ is 0.04.

Applicants noted the desirability of a tobacco wax product, when tested using the above methods, i.e. (110 mL puff/30 sec interval/3 sec duration), and measured using LP-721 method, that yielded a Diacetyl level of BQL μg/puff, where LOQ is 0.04.

Applicants noted the desirability of a tobacco wax product, when tested using the above methods, i.e. (110 mL puff/30 sec interval/3 sec duration), and measured using LP-717 method, that yielded nicotine level of greater than 0.1 mg/puff, preferably greater than 1.2 mg/puff, more preferably greater than 1.4 mg/puff, still more preferably greater than 1.6 mg/puff, and most preferably greater than 1.8 mg/puff.

We claim:

1. A cartridge, suitable for vaporizing a tobacco wax composition, comprising a chamber in which a tobacco wax composition may be provided, a primary heating element configured to vaporize the tobacco wax composition, and a secondary heating element configured to heat the tobacco wax composition to a temperature above 35° C. to increase flowability of the tobacco wax composition, wherein areas of the chamber configured to be in contact with the tobacco wax composition are comprised of a material with a surface energy of less than 20 Dynes/cm, whereby heating of the tobacco wax composition by the secondary heater in combination with the areas of the chamber in contact with the tobacco wax composition being comprised of the material with a surface energy of less than 20 Dynes/cm decreases adherence of the tobacco wax composition to the chamber and increases utilization of the tobacco wax composition as compared to a cartridge not having a secondary heating element configured to heat the tobacco wax composition to a temperature above 35° C. to increase flowability of the tobacco wax composition and not having areas of the chamber configured to be in contact with the tobacco wax composition comprised of a material with a surface energy of less than 20 Dynes/cm, wherein the areas of the chamber in contact with the tobacco wax composition are comprised of PTFE or FEP.

2. The cartridge according to claim 1, wherein the secondary heating element is longer than one centimeter.

3. The cartridge according to claim 1, wherein the secondary heating element has a surface area of 0.05 sq. cm to 0.6 sq. cm.

4. The cartridge according to claim 1, further comprising an airtube where the airtube is substantially comprised of a material with a k value (W/m K) of greater than 70.

5. The cartridge according to claim 1, wherein the areas of the chamber configured to be in contact with the tobacco wax composition comprise a material with a k value (W/m K) of greater than 70.

6. A cartridge, suitable for vaporizing a tobacco wax composition, comprising a chamber, a tobacco wax composition provided in the chamber, a primary heating element configured to vaporize the tobacco wax composition, a secondary heating element configured to heat the tobacco wax composition to a temperature above 35° C. to increase flowability of the tobacco wax composition, wherein areas of the chamber in contact with the tobacco wax composition are comprised of a material with a surface energy of less than 20 Dynes/cm, whereby heating of the tobacco wax composition by the secondary heater in combination with the areas of the chamber in contact with the tobacco wax composition being comprised of the material with a surface energy of less than 20 Dynes/cm decreases adherence of the tobacco wax composition to the chamber and increases utilization of the tobacco wax composition as compared to a cartridge not having a secondary heating element configured to heat the tobacco wax composition to a temperature above 35° C. to increase flowability of the tobacco wax composition and not having areas of the chamber in contact with the tobacco wax composition comprised of a material with a surface energy of less than 20 Dynes/cm, wherein the areas of the chamber in contact with the tobacco wax composition are comprised of PTFE or FEP.

7. The cartridge according to claim 6, wherein the tobacco wax composition has a nicotine content of greater than 2%.

8. The cartridge according to claim 6, wherein the tobacco wax composition is flowable and has a viscosity greater than 10,000 centipoise, measured at 2.5 rpm, 25.4° C.

9. The cartridge according to claim 8 wherein the tobacco wax composition is thixotropic.

10. The cartridge according to claim 8, wherein the tobacco wax composition comprises 30% to 65% of a vapor agent.

11. The cartridge according to claim 6, further comprising an airtube where the airtube is substantially comprised of a material with a k value (W/m K) of greater than 70.

12. The cartridge according to claim 6, wherein the areas of the chamber in contact with the tobacco wax composition comprise a material with a k value (W/m K) of greater than 70.

13. The cartridge according to claim 6, wherein the secondary heating element is longer than one centimeter.

14. The cartridge according to claim 6, wherein the secondary heating element has a surface area of 0.05 sq. cm to 0.6 sq. cm.

* * * * *